US005263835A

United States Patent [19]

Schmidt

[11] Patent Number: 5,263,835

[45] Date of Patent: Nov. 23, 1993

[54] BUILDING CONSTRUCTION SYSTEM

[75] Inventor: Hans H. Schmidt, Victoria, Australia

[73] Assignee: Lubeca Construction Systems Pty. Ltd., Victoria, Australia

[21] Appl. No.: 730,814

[22] PCT Filed: Feb. 6, 1990

[86] PCT No.: PCT/AU90/00042

§ 371 Date: Jul. 26, 1991

§ 102(e) Date: Jul. 26, 1991

[87] PCT Pub. No.: WO90/09497

PCT Pub. Date: Aug. 23, 1990

[30] Foreign Application Priority Data

Feb. 8, 1989 [AU] Australia ..... PJ2627

[51] Int. Cl.[5] ..... E04G 11/28; E04G 13/00

[52] U.S. Cl. ..... 425/64; 249/20; 264/33; 425/65

[58] Field of Search ..... 249/19, 20; 264/33; 425/63, 64, 65

[56] References Cited

U.S. PATENT DOCUMENTS

| | | | |
|---|---|---|---|
| 3,182,374 | 5/1965 | Cook | 249/20 |
| 3,252,199 | 5/1966 | Bossner | 425/65 |
| 3,510,098 | 5/1970 | Fox | 249/20 |
| 4,016,228 | 4/1977 | Schmidt | 425/65 |
| 4,050,255 | 9/1977 | Ahlgren | 425/65 |
| 4,108,583 | 8/1978 | Ellen | 425/65 |

FOREIGN PATENT DOCUMENTS

| | | |
|---|---|---|
| 509057 | 2/1979 | Australia . |
| 18541 | 12/1988 | Australia . |
| 1383670 | 2/1975 | United Kingdom . |

*Primary Examiner*—Jay H. Woo
*Assistant Examiner*—James P. Mackey
*Attorney, Agent, or Firm*—Biebel & French

[57] ABSTRACT

A building construction system for progressively forming a plurality of vertical superimposed concrete segments. A plurality of screw jacks form support columns and carry at their upper ends sub-frames upon which an overlying main frame is positioned. Formworks are suspended from the main frame and are moveable into position for pouring concrete to form the segments. The screw jacks are supported on a horizontal building element preceding a previously constructed horizontal building element and are retractable. The main frame is supported on adjustable struts for repositioning the screw jacks prior to extension to a subsequent segment forming position.

13 Claims, 23 Drawing Sheets

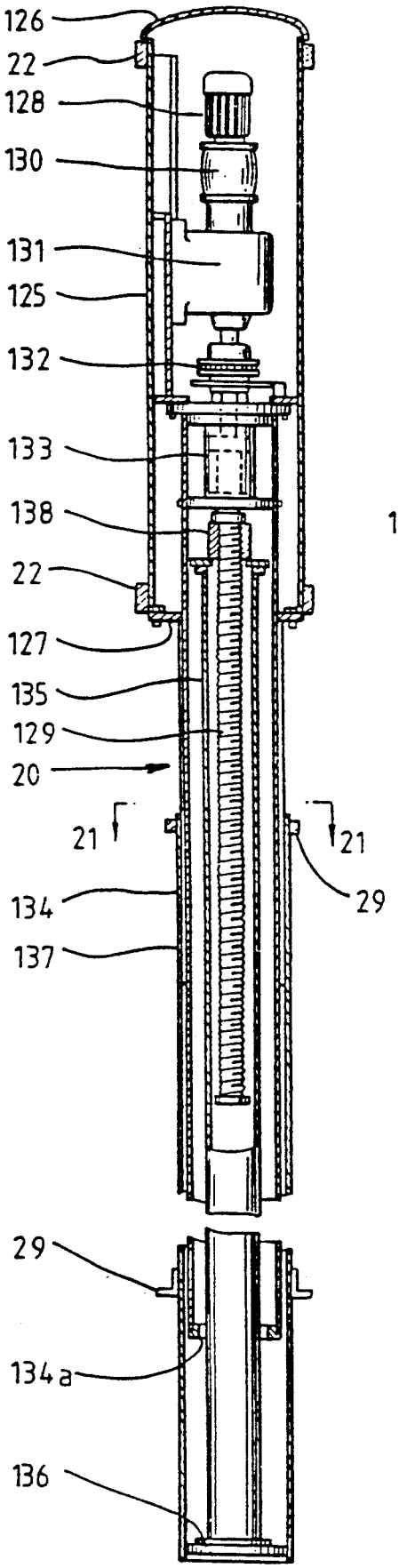
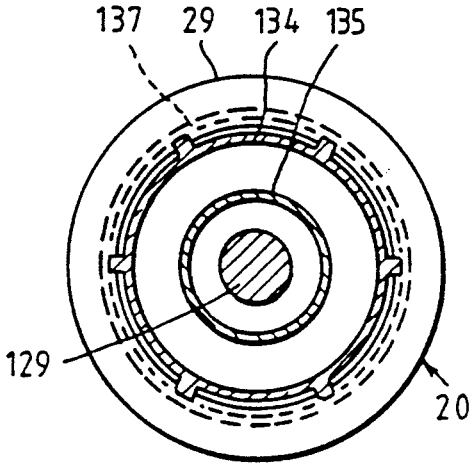
FIG. 21.
FIG. 20.

BUILDING CONSTRUCTION SYSTEM

TECHNICAL FIELD

This invention relates to an improved self-climbing system for the incremental construction of walls, and in particular the construction of vertical walls of concrete in the building and construction industry. The invention also relates to the construction of other concrete members in building structures, such as perimeter and band beams, although in its broadest form the invention relates primarily to the construction of vertical concrete elements, such as vertical walls forming the central service core of the building structure and/or the perimeter of the building structure.

More particularly the invention relates to a complete highrise construction system which involves a method and apparatus for the incremental in-situ construction of the vertical concrete elements (perimeter walls and service cores), perimeter and band beams, and to a limited extent the floor slabs, in office towers, highrise condominiums and tall civil structures.

BACKGROUND ART

Existing self-climbing systems, such as those disclosed in Australian Patent No. 490759, and our copending Australian Patent Application No. 18541/88, have limitations with regards to the flexibility of the systems.

It is the object of the present invention to provide a system which is self-climbing and after the initial assembly requires no external cranage for lifting from one level to another. The system preferably carries with it all formwork components, safety decks, work platforms and perimeter safety screening, that is, all that is necessary for the safe working of personnel in and about the apparatus at all times to the completion of the structure. Upon building completion the system becomes redundant and is dismantled by external means.

A further object of the invention is to provide a system which is capable of constructing structures of any size, shape or height; and although primarily concern with the construction of vertical walls, can have the versatility to construct the following groups of concrete elements.

(a) Perimeter walls, beams and columns, together with internal columns, beams, shear walls and all central core walls concurrently (b) Half the relevant building elements cast by the system at one level, and the other half at one level advanced in a construction, conveniently split to suit the geometry and/or construction of the building.

(c) Perimeter walls, beams and columns only.

(d) Perimeter walls, beams and columns together with internal columns and beams and shear walls only. In this case the central core walls could be constructed ahead of the main floor areas by employing a conventional slip or jump form system.

(e) Perimeter walls, beams and columns at one level and the central core walls at an advanced level in a split system.

(f) All central core walls only.

None of the existing self-climbing systems, including those of the patent and patent application referred to previously, can achieve such versatility of operation which are the objectives of the present invention.

Since the introduction of central core climbing systems (slip or jump form systems the subject of the aforementioned Patent and Patent applications), and the introduction of fast cycle table-form systems for horizontal elements such as floor slabs, the construction of the perimeter of a building has been critical to floor to floor cycle times in the construction of multi-storey buildings. This is due largely to site crane dependence, the concentration of elements around the perimeter, and the safety requirements for personnel around the edge of the building in the formation of the perimeter.

The preferred object of the present invention is to speed up the construction of perimeter, and like elements, in the construction of multi-storey buildings.

DISCLOSURE OF THE INVENTION

The present invention envisages a building construction system for progressively forming a plurality of vertical superimposed concrete segments in a building construction, said system comprising a plurality of jacking devices forming support columns and each carrying at their upper ends sub-frames for the system onto which a main frame overlying the positions at which the segments are to be formed is adapted to be positioned, and from which the form works are suspended to be movable to positions to define spaces within which concrete is poured to form said segments, said jacking devices being adapted to be supported on a lower previously constructed level of said building preceding a previously constructed level of said building and retractable while said main frame is supported on temporary supports to reposition said jack means for support on the previously constructed level of said building structure.

With the system of the present invention, external cranes or other lifting machines are limited to the initial assembly and the final dismantling of the system, and to the supply of building materials, such as concrete, reinforcing steel and structural steel. The system after assembly is self sufficient in climbing from one level to another.

The system carries all the formwork components necessary to form the groups of concrete elements according to any one of the schedules.

The system can carry with it all the necessary access platforms for tradesmen and workmen, and forming an integral part of the system, together with safety screens at the perimeter or atriums of buildings and protecting two or more levels below.

A typical construction cycle employing the system might be as follows:

(1) Form the lifts/central core region with a conventional self-climbing core forming system or a system in accordance with the present invention. Advance the core construction together with any necessary associated floor area sufficiently ahead of the general floor levels being formed leaving construction joints about the core to receive main floor slabs and floor beams.

(ii) As soon as the perimeter walls, or columns and beams, are at a level which is sufficiently typical of the structure and are clear of any surrounding ground, the system can be employed. First the perimeter elements are poured—walls, or columns and beams. Such elements have construction joints to receive horizontal elements such as beams and slabs.

(iii) The system is advanced to clear the next floor level and this floor can then be poured, including into the receiving perimeter construction joints.

(iv) As the immediately formed level is available to stabilize the system, the next level of perimeter elements can be poured, and so on.

Preferably, the positions of the sub-frames relative to the jacking devices and also as a consequence the pouring chutes are adjustable, whereby the sub-frames and the main frame supported thereon will extend further beyond or close to the jacking devices, for example, to progressively shift the perimeter wall inwardly of the building as the building construction continues whereby to form a progressively inwardly stepped perimeter wall.

Preferably the perimeter safety screens extend several floors below that from which a particular wall section is being formed at any time, whereby workman situated on platforms suspended from the safety screen structure can carry out finishing work at the floors below, such as surface finishing and glazing, within the relative safety of the safety screen suspended from the overhead framework, and which safety screen will rise progressively with the framework.

Preferably also in relation to the assembly of the safety screen, prefabricated screen sections of standardized width are provided and have arrangements of holes or slots adjacent their edges and extending in lines, inwardly of the edges of each screen section, whereby with varying lengths of perimeter wall, gaps between screen sections during assembly of the safety screen which are less than the width of the screen sections themselves, can be filled by overlapping adjacent edges of the screen sections whereby a selected pair of holes or slots in the sections align to receive attachment means such as bolts or other fastening devices.

Preferably the main frame is formed from prefabricated frame sections which are brought to the site and positioned onto the pre-positioned jacking devices and sub-frames, whereafter the frame sections are connected together to form a unitary main frame, or some may be left unconnected whereby individual lengths of the main frame can be raised independently of each other to allow vertical concrete walls or components to be formed at differing heights in accordance with a predetermined building schedule to provide some versatility in utilization of building workers.

Preferably, for safety reasons, mesh covers are provided over the pouring chutes between formworks whereby concrete can be poured through the mesh and reinforcement can pass therethrough, whilst at the same time preventing building workers from falling into and through the pouring chutes. Preferably the mesh covers are hinged to adjacent working platforms whereby they can be swung upwardly out of the way when accessed to the pouring chutes might be required.

Preferably means are provided to allow fine adjustment of the formworks at their points of suspension from the overhead main frame.

BRIEF DESCRIPTION OF THE DRAWINGS

Four preferred embodiments of the invention will now be described with reference to the accompanying drawings, in which;

FIG. 20 is a cross-sectional view taken along line 20—20 of FIG. 15;

FIG. 21 is a cross-sectional view taken along line 21—21 of FIG. 20;

BEST MODES FOR CARRYING OUT THE INVENTION

Figure 1:
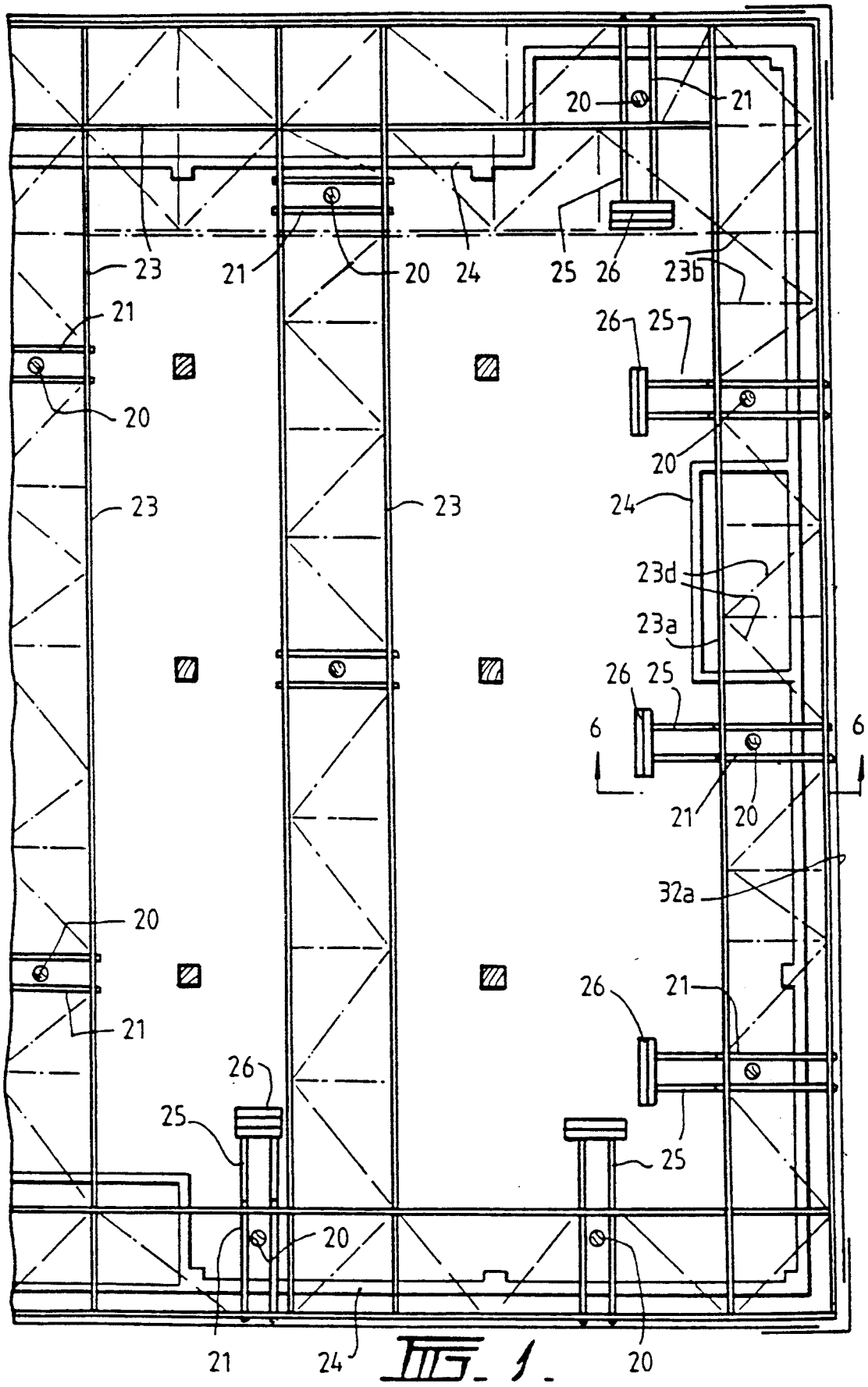
FIG. 1 is a schematic plan view of a portion of a building being constructed utilizing one preferred form of the present invention.

Referring to FIGS. 1 to 11 of the drawings, the first preferred embodiment of the invention comprises a plurality of jacking devices in the form of extendable jacks or hydraulic rams 20, strategically positioned having regard to the shape of the building to be constructed and positioned where vertical concrete walls and beams are to be constructed. The uppermost ends of each of the jacks or hydraulic rams carry sub-frames 21 formed from a series of longitudinal frame members 21*a*, lateral frame members 21*b*, and vertical frame members 21*c*, collectively affixed to the upper most ends of the rams via connecting plates 22 between the upper and lower pairs of frame members 21*a*.

The sub-frames 21 in turn support a main frame 23 for the system and overlying the walls, columns and other vertical elements 24 of the building construction to be formed, and consisting of longitudinal frame members 23*a*, lateral frame members 23*b*, vertical frame members (not visible) and diagonals 23*d*. The longitudinal frame members 23*a* are adapted to overlie support members 21*d* carried by the sub-frames 21.

In addition, each of the sub-frames 21 at the perimeter wall receives a counterweight frame 25, including longitudinal frame members 25*a* received within the longitudinal frame members 21*a* of the sub-frames, which members 21*a* may be in the form of channel sections or hollow-sections within which the frame members 25*a* are received. The counterweight frames 25 also include vertical members 25*b*, and the outermost ends of the counterweight frames support counterweights 26 the weight of which is calculated to off-set the weight of the system on the opposite side of the axes of the rams at the positions of the rams, to thereby provide a stable balanced structure for the system.

Figure 2:
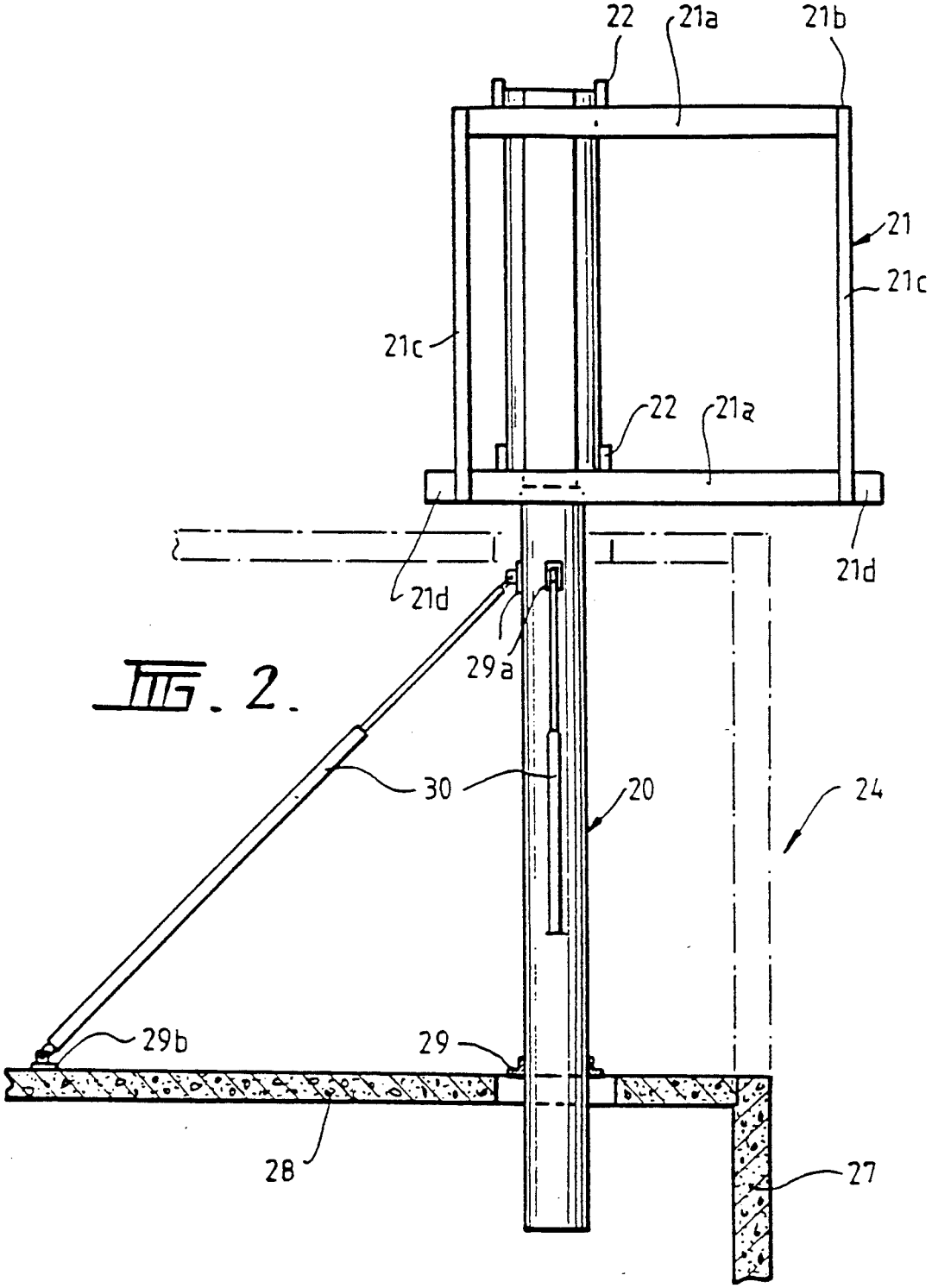
FIG. 2 is a side elevational view of part of the system during an initial phase of the assembly thereof.
Figure 3:
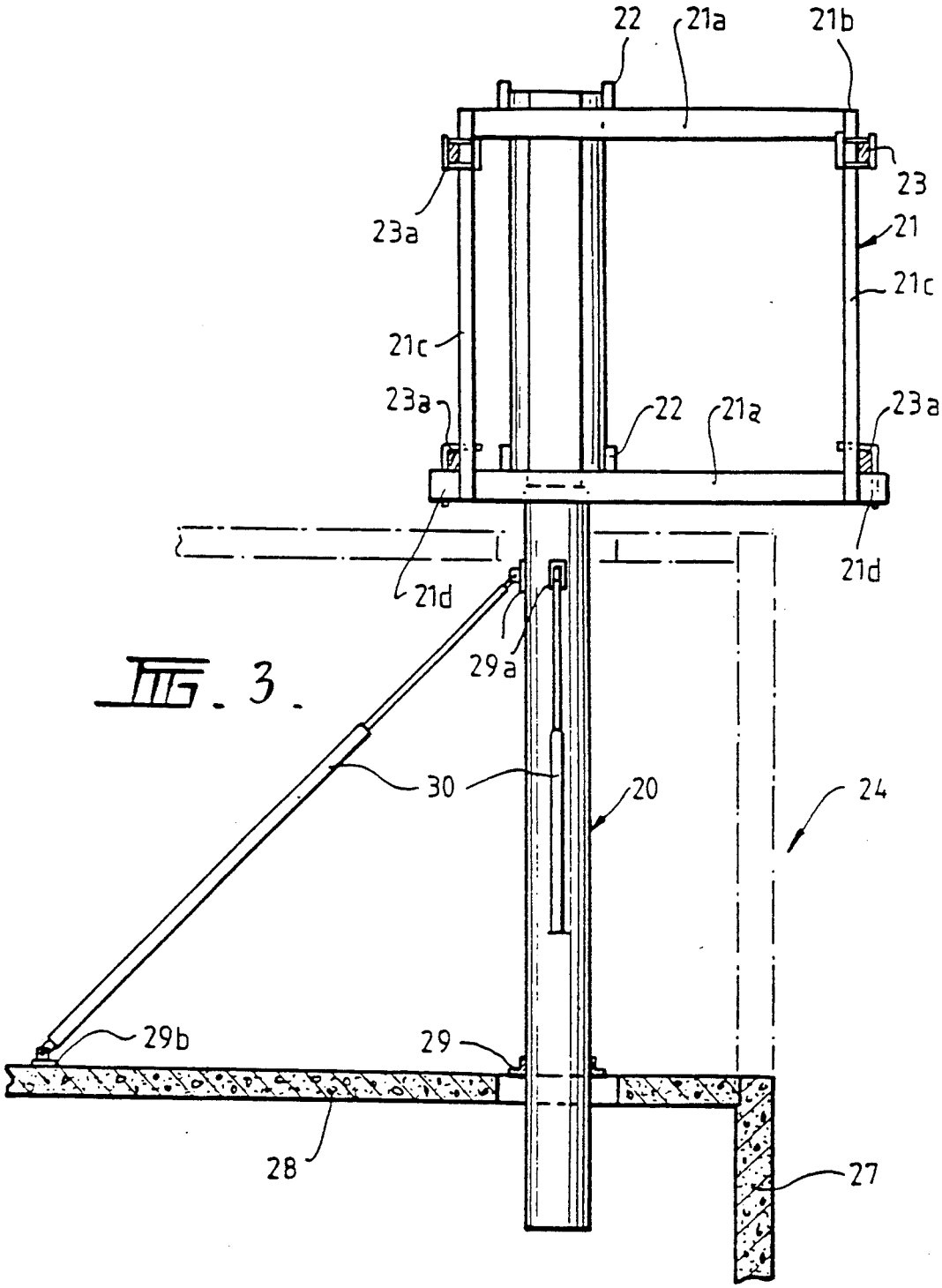
FIG. 3 is a side elevational view of the system during a subsequent phase of the assembly thereof.
Figure 4:
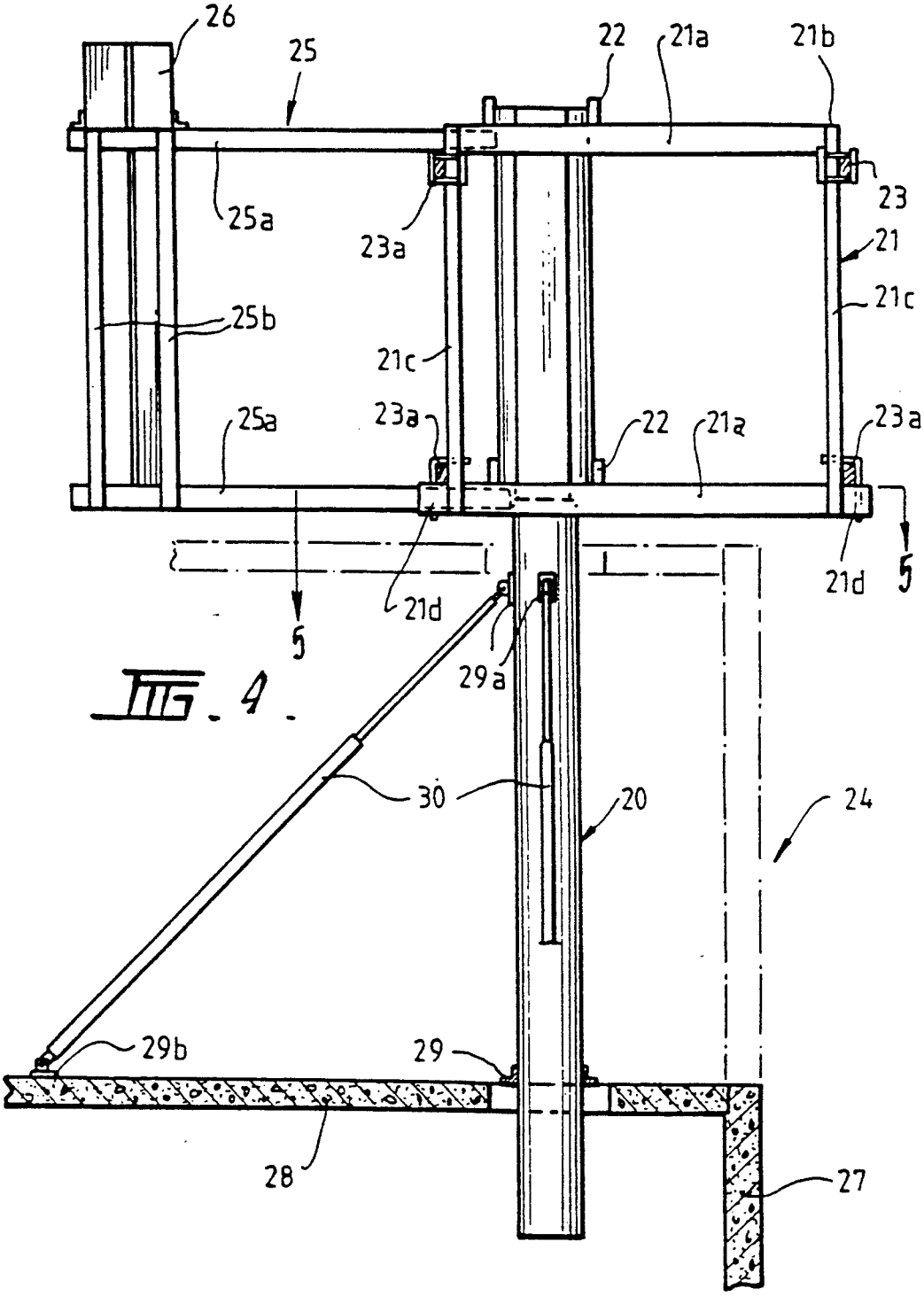
FIG. 4 is a side elevational view of the system after completion of the assembly thereof.
Figure 5:
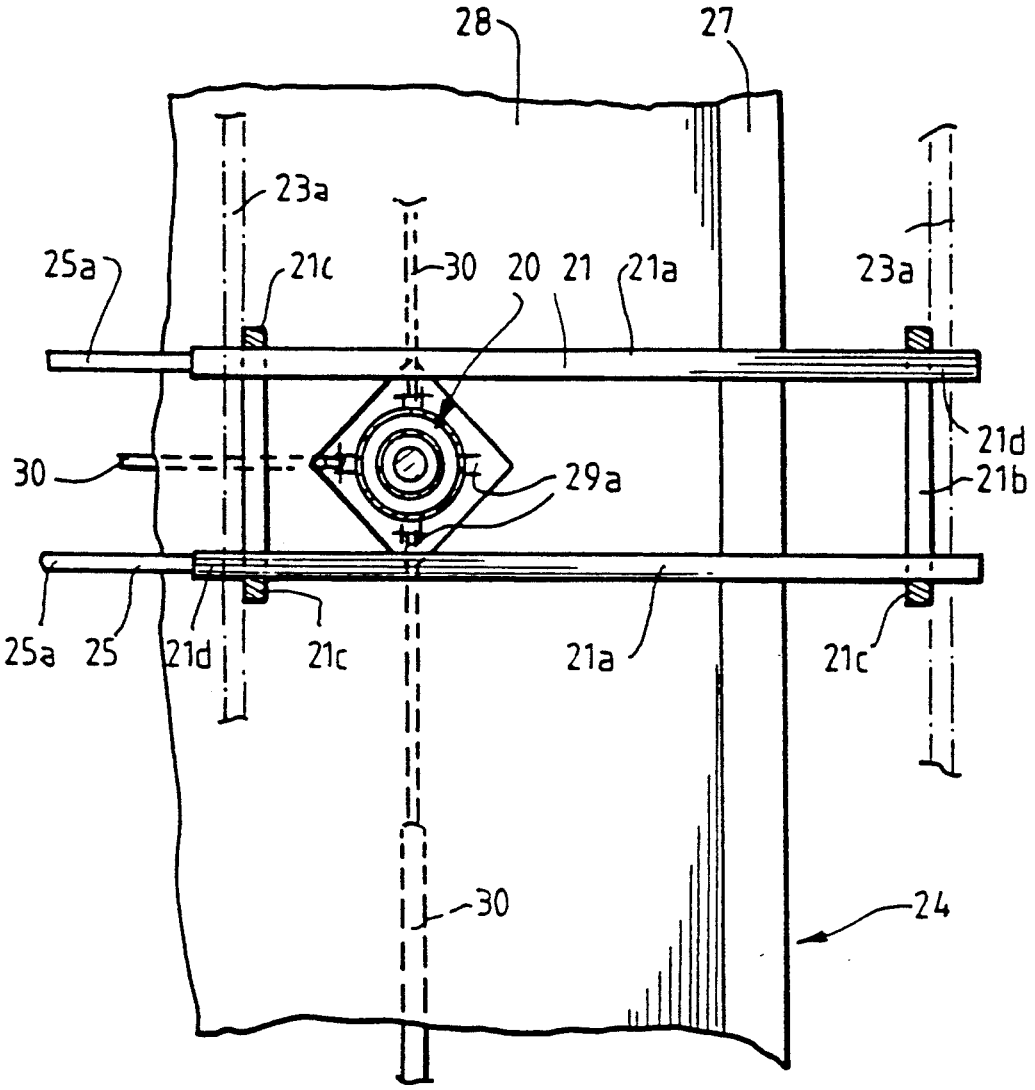
FIG. 5 is a cross-sectional view taken along line 5—5 of FIG. 4.

FIGS. 2 to 5 of the drawings show the various stages during the assembly of the system. Prior to assembly of the system a first building level is formed using conventional wall and slab casting procedures, to provide the vertical walls 27, and any other vertical components of the building structure, and the first level floor slab 28. With reference to FIG. 2 of the drawings, the lower ends of the rams 20 are positioned through apertures in the floor slab 28 and support brackets 29 connect the rams 20 to the floor slab, with adjustable struts 30 being utilized to further support and vertically align the rams between anchor points 29*a* on the rams and anchor points 29*b* on the floor slab 28. With reference to FIGS. 3 and 5, the main frame 23 is then assembled on top of the sub-frames 21 with the longitudinal frame members 23*a* engaging the support members 21*d* of the sub-frames whereby the whole of the main frame, or independent sections thereof, are supported on jacks or rams 20 via their sub-frames 21. The counterweight frames 25 are thereafter inserted into the sub-frames and as formworks 31 (as shown in FIG. 6 of the drawings) are placed in position on the main frame, the counterweights 26 are positioned and adjusted to balance the system on either side of the axes of the rams 20.

To complete the system, various working decks 32 for workmen and tradesmen are position within and suspended from the main frame, whilst members 23*e* extending vertically downwardly from the main frame carry safety screens 32*a* which extend to at least the level below, if not several levels below, the level being constructed. In addition, chutes 33 are provided through the deckings 32 on the main frame to communicate with the spaces between the formworks 31 when the formworks are moved to the wall segment casting positions, and/or positions for the casting of other vertical components of the building structure. Formworks 31 are in turn suspended from the sub-frames or the main frame on rollers 34 which allow the form works to be rolled into and away from the required concrete casting positions.

The progressive casting of vertical building components, such as vertical perimeter walls and the vertical walls of the building service core, and any vertical building columns, is now described with reference to FIG. 6 to 11 of the drawings.

Figure 6:
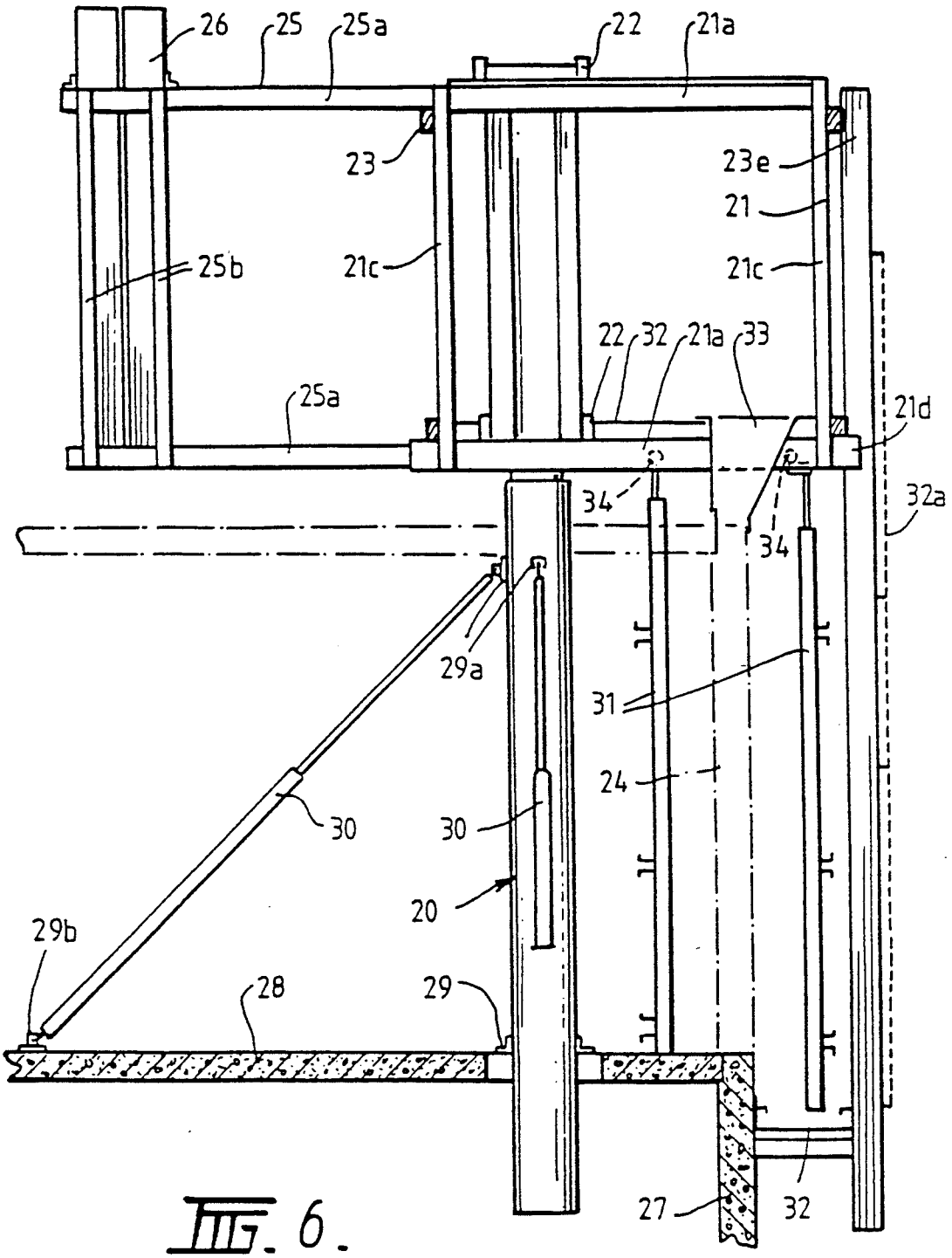
FIG. 6 is a cross-sectional view taken along line 6—6 of FIG. 1 showing a first stage in the operation of the system for forming a wall segment.
Figure 13:
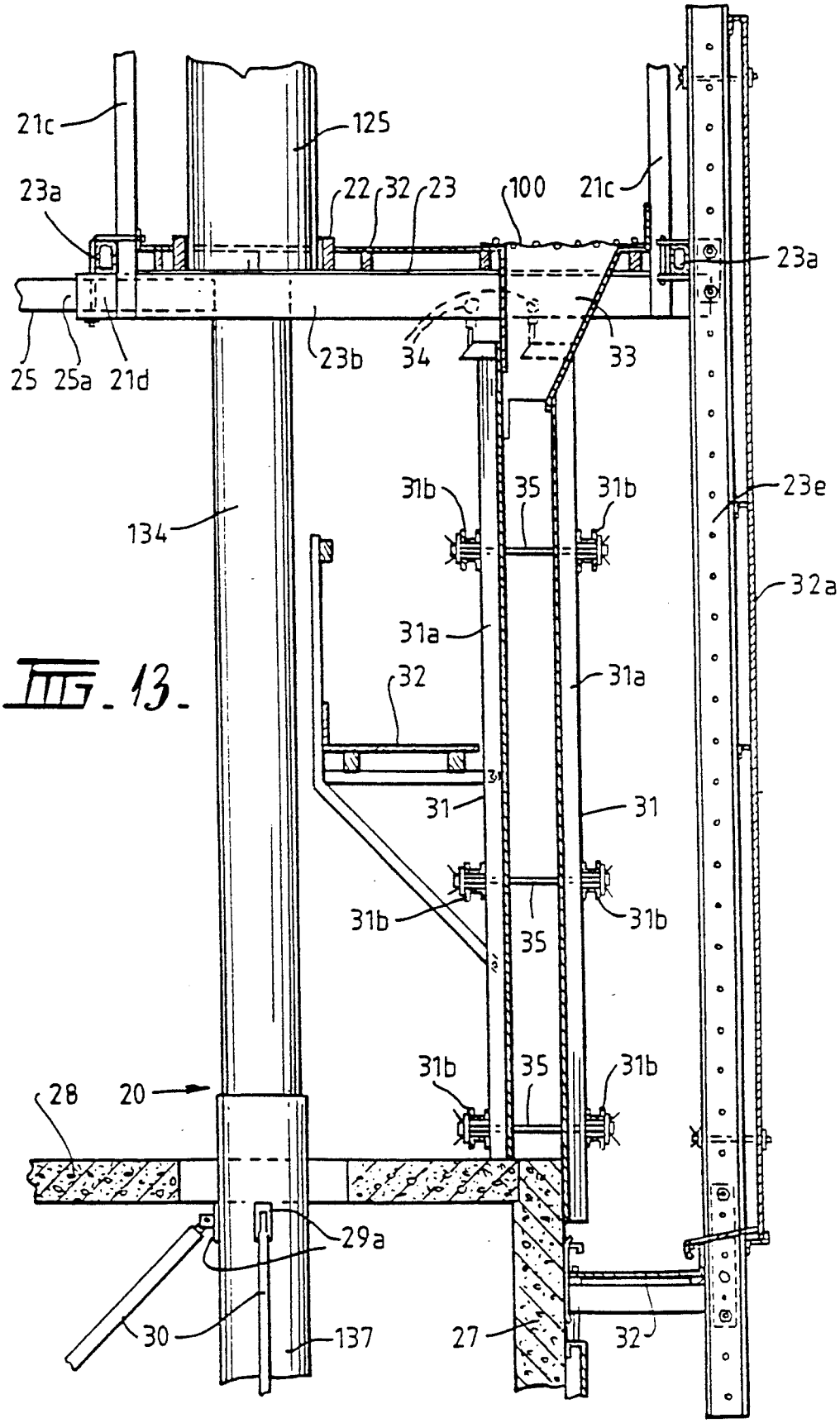
FIG. 13 is a side elevational view showing in more detail the components of the system utilized in the first embodiment of the invention.

After the system has been assembled on the previously formed first level of the building construction as shown in FIG. 6 of the drawings, the formworks 31 are moved into position, and with reference to FIG. 13 of the drawings, are held in position by tie bars 35 extending through the combination of vertical and horizontal members 31*a* and 31*b* forming the main structural members for the formworks.

Figure 7:
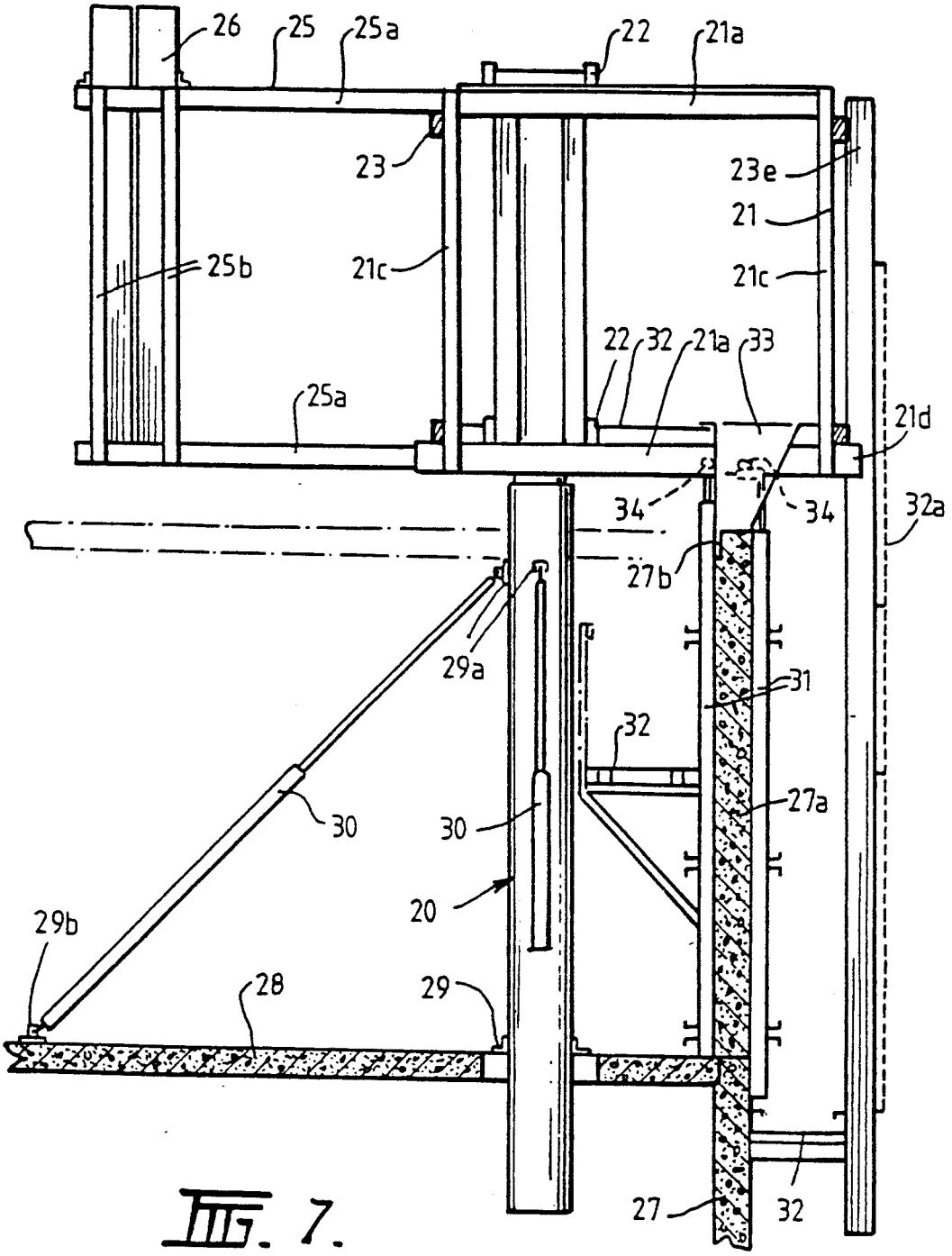
FIG. 7 is a view similar to that of FIG. 6 showing the next stage in the formation of the wall segment.
Figure 8:
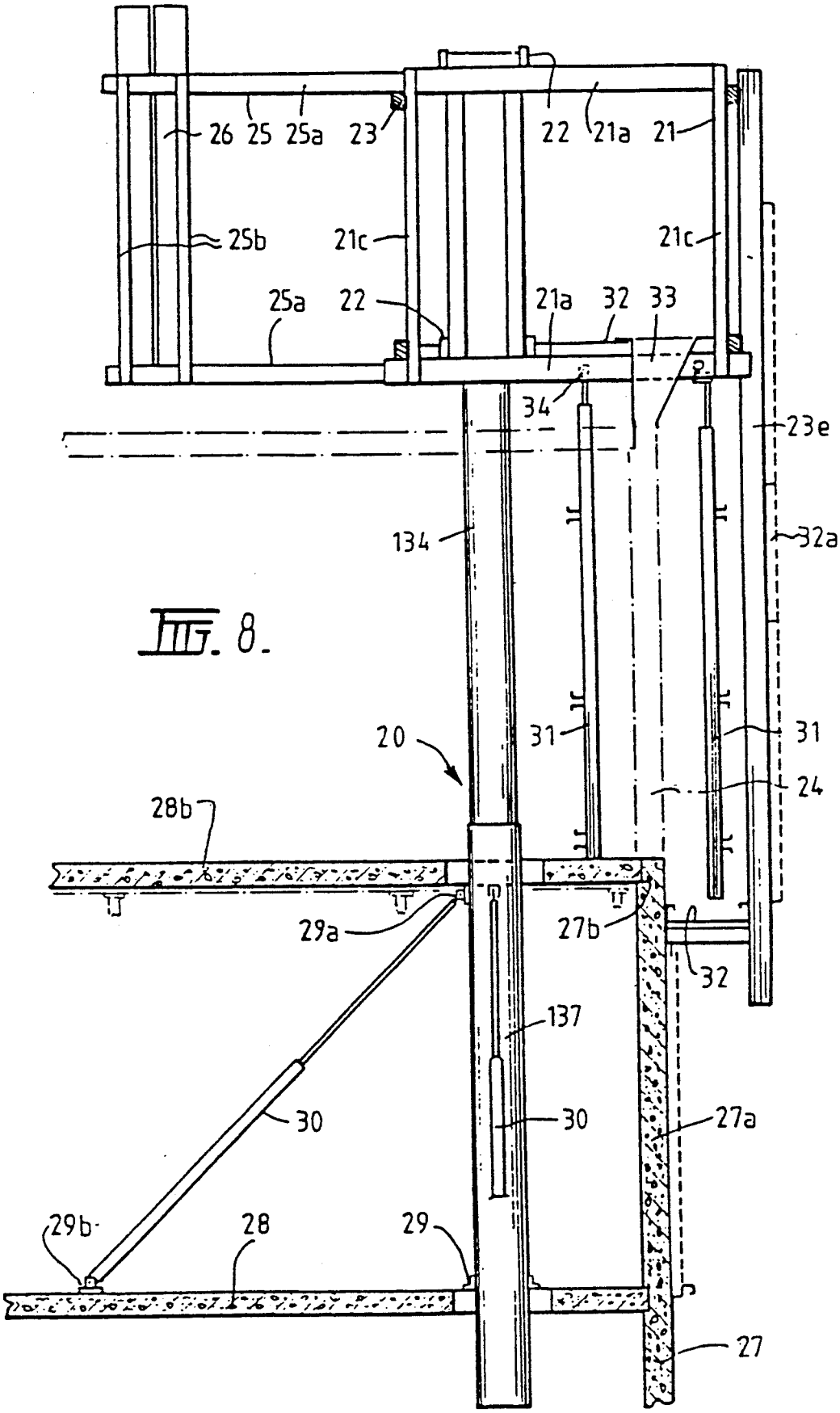
FIG. 8 is a view similar to those of FIG. 6 and 7, showing the repositioning of the system preparatory to forming the next superimposed wall segment.

As shown in FIG. 7 of the drawings, the wall segment 27*a*, and other vertical components for the second level of the building are cast and allowed to cure, whereafter the formworks are detached from the tie bars and separated, whereafter the jacks rams 20 are extended to the position shown in FIG. 8. The floor slab 28*b* for the next level is also cast using conventional floor slab casting techniques with its edges cast into ledgers 27*b* on the inner upper edges of the adjacent wall segments, and with reference to FIG. 8 of the drawings, the floor slabs are cast with apertures through which the jacks 20 extend.

Figure 9:
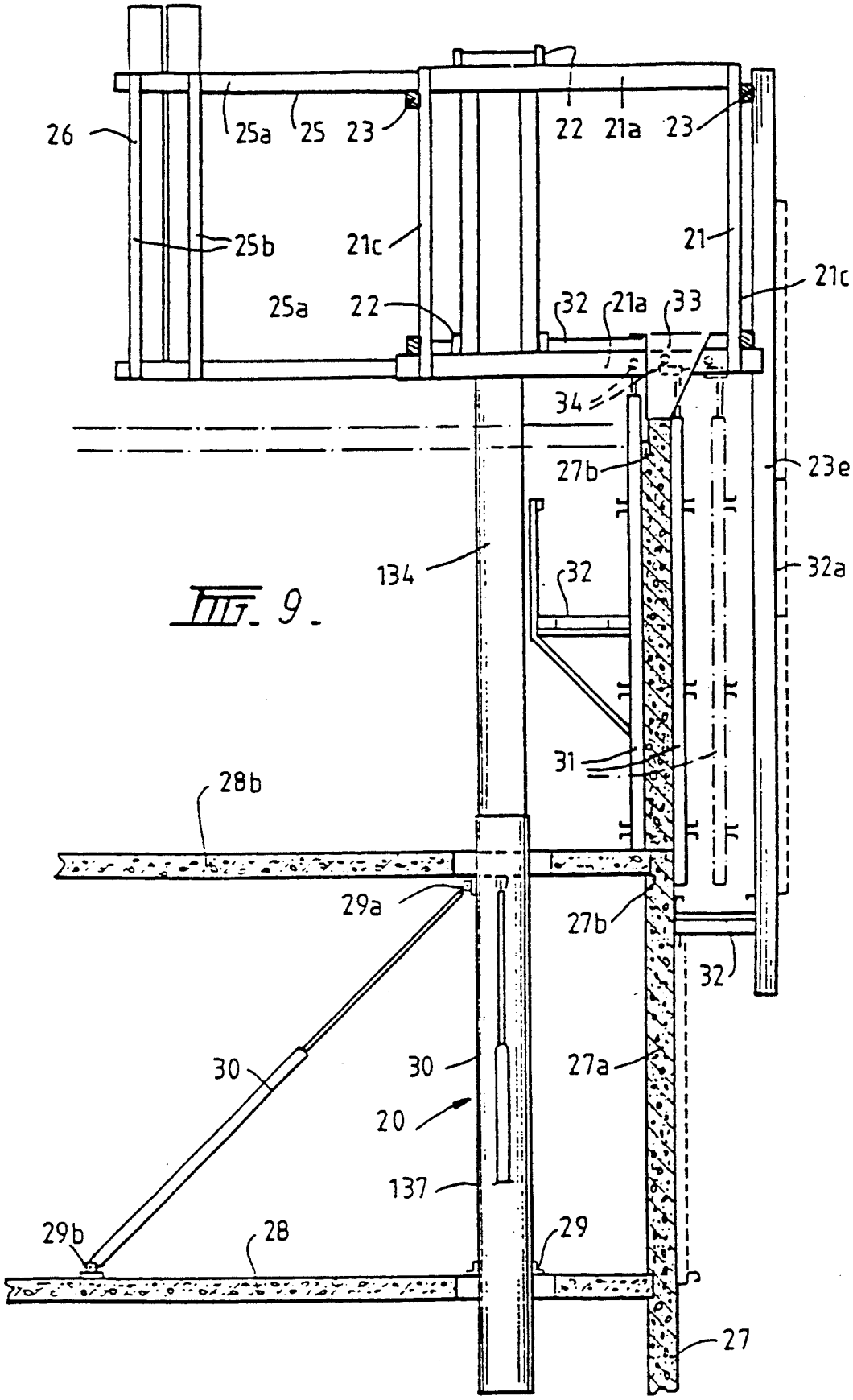
FIG. 9 is a view similar to FIG. 8 showing the next stage in the formation of the wall segment.

As shown in FIG. 9 of the drawings, at the next building level, the formworks 31 are repositioned and tied together to define spaces for the next wall segment and other vertical building components at that level, and once again a concrete pour is made.

Figure 10:
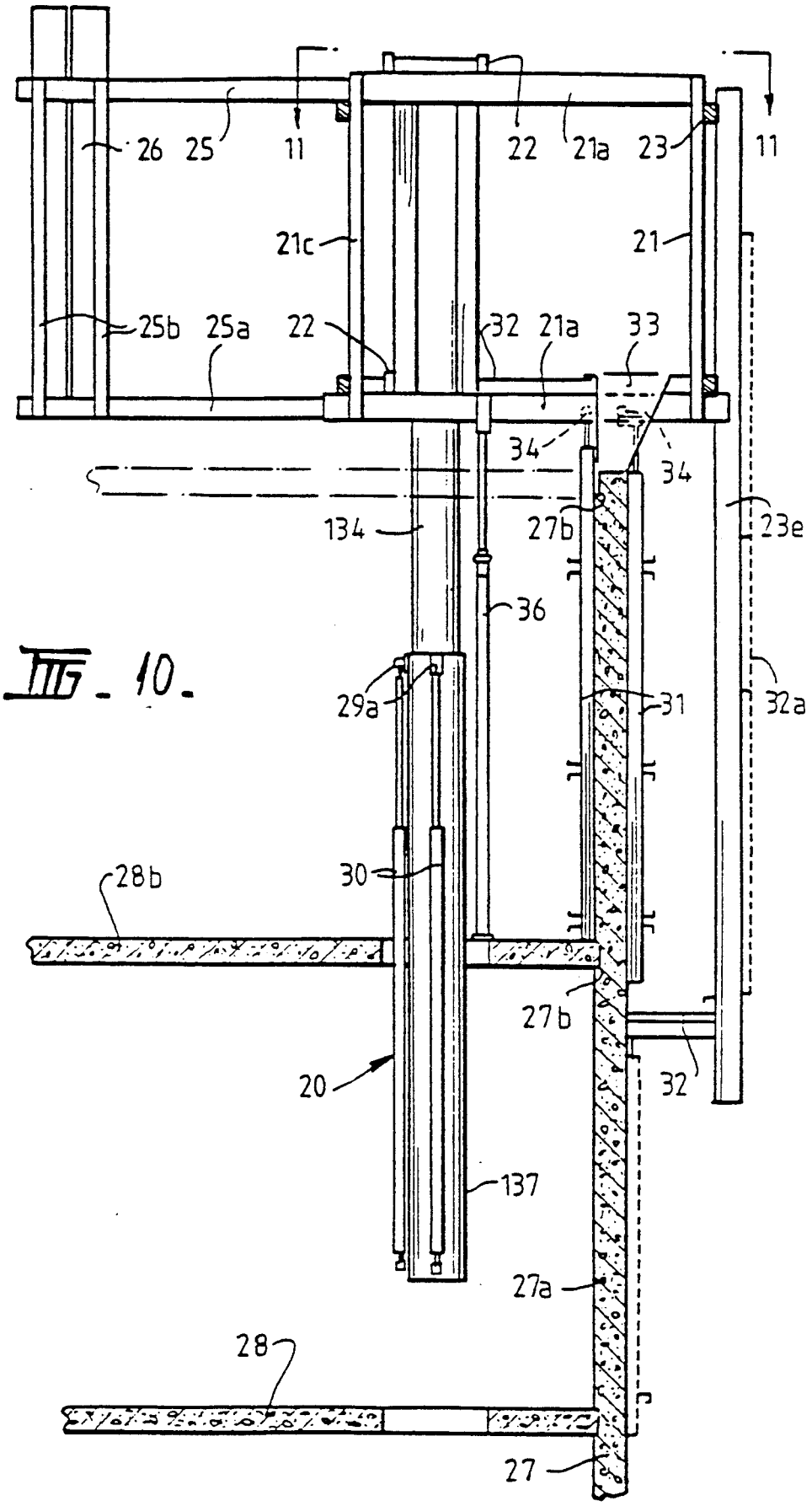
FIG. 10 is a view similar to those of FIGS. 8 and 9 showing the repositioning of the jacking part of the system in preparation for repeating the stages of construction from FIG. 7 through to FIG. 9.
Figure 11:
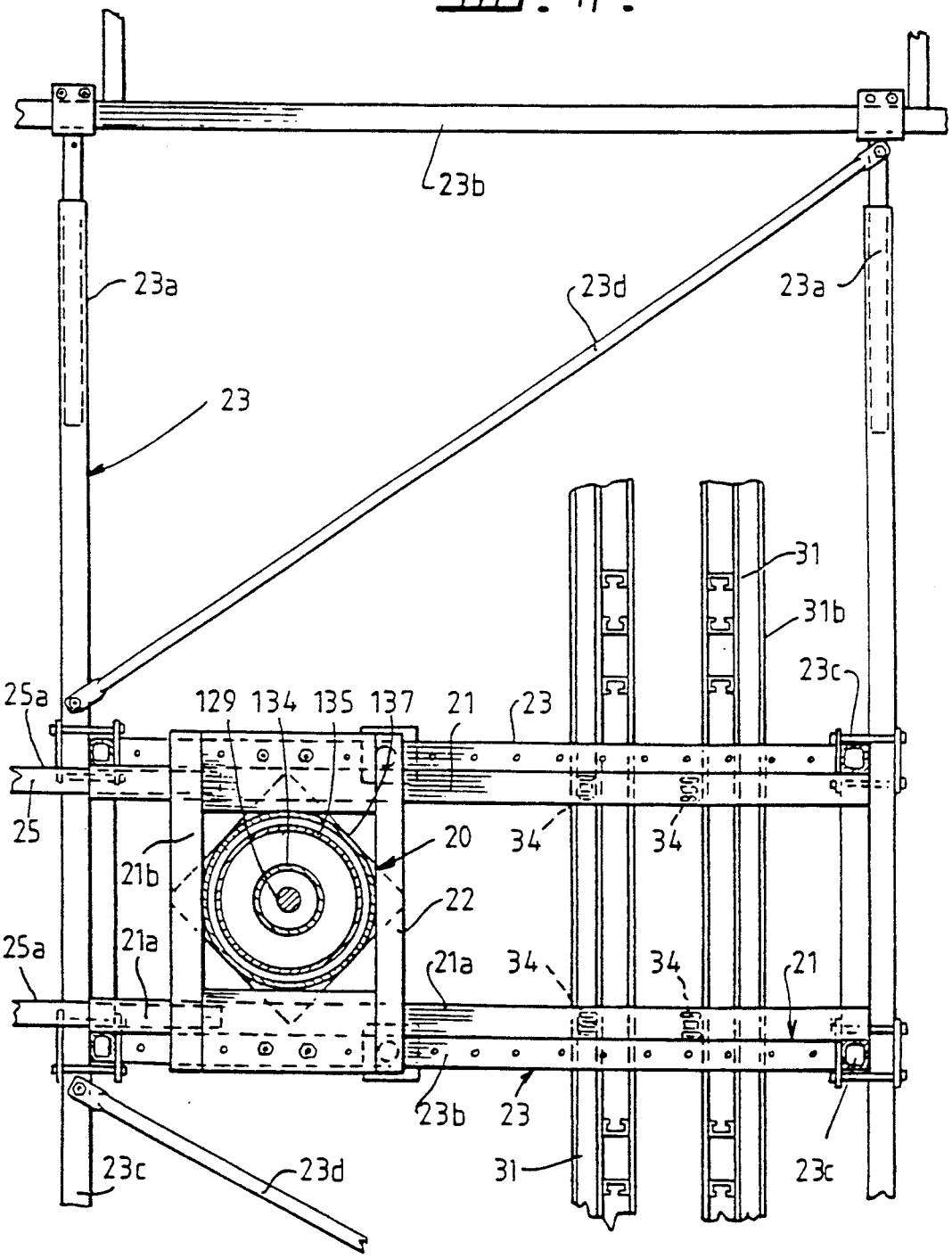
FIG. 11 is a cross-sectional view taken along line 11—11 of FIG. 10.

As shown in FIG. 10 of the drawings, temporary vertical adjustable struts 36 are positioned between the main frame or sub-frames of the system and the underlying floor slab 28*b* to support the system whilst the jacks 20 are retracted to draw their lower sections upwardly through the apertures in the floor slab 28*b* to be thereafter supported by the brackets 29 and by the struts 30 in the manner shown in FIG. 2. The procedure as per FIGS. 7 to 10 is thereafter repeated for subsequent levels.

Generally at strategic times during the operation of the system the sub-frames are braced to the builing structure below to provide rigidity.

Figure 12:
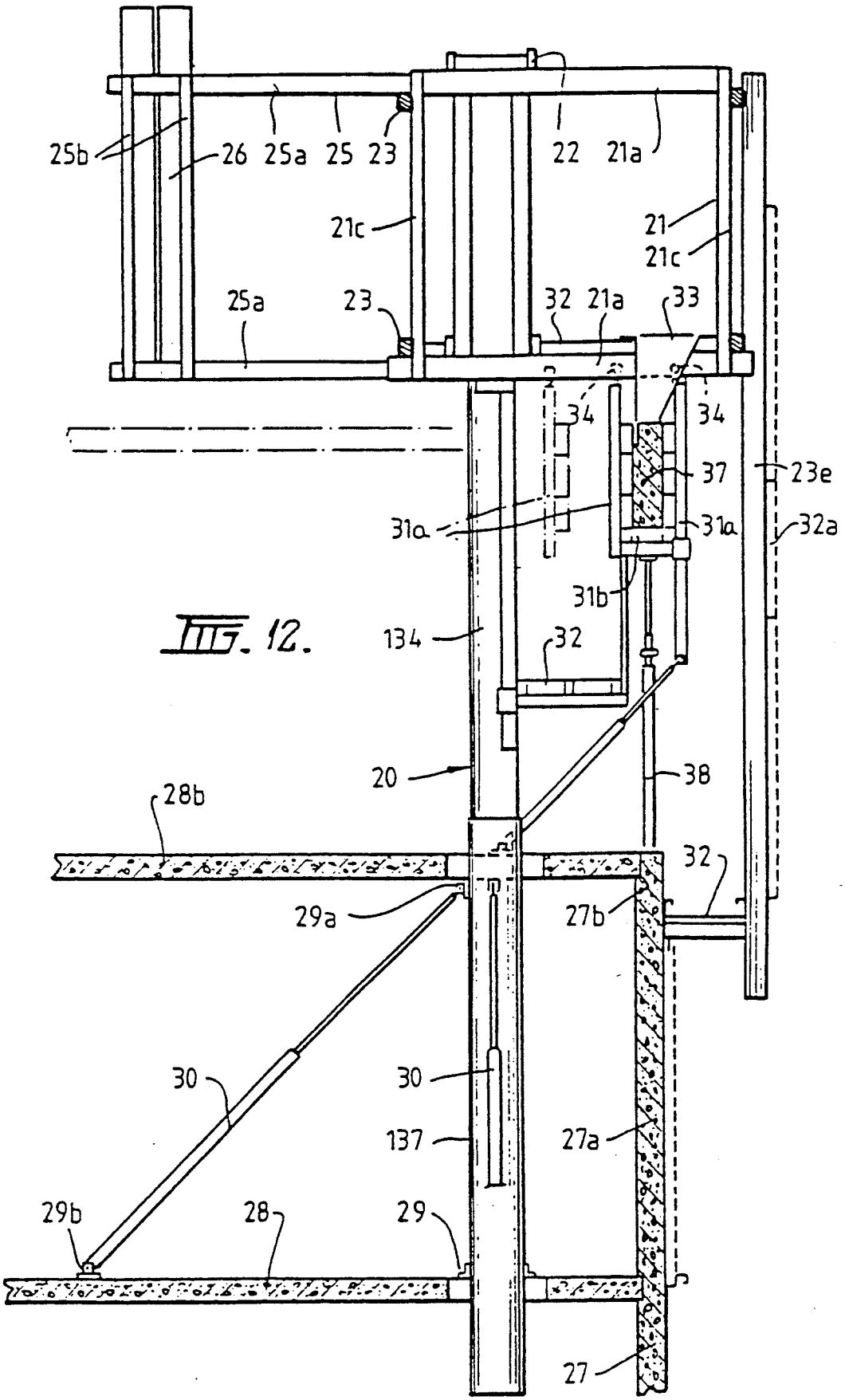
FIG. 12 is a side elevational view showing a system in accordance with a second embodiment of the invention.

In the embodiments of FIGS. 1 to 10, any openings, such as windows through the perimeter walls of the building, are formed by providing suitable block-outs between the opposing wall forming formworks 31, whilst in the alternative embodiment of FIG. 12, openings, such as perimeter window openings as shown in FIG. 12, are formed by casting horizontal separating wall segments 37 between adjacent levels of the building utilizing short formworks 31*a* with lower formworks 31*b* being provided to define the bottom of the concrete casting cavity and held into position by adjustable vertical struts 38. In other respects the components of the system are identical to those of the first embodiment and the same identifying reference numerals have been utilized.

Figure 14:
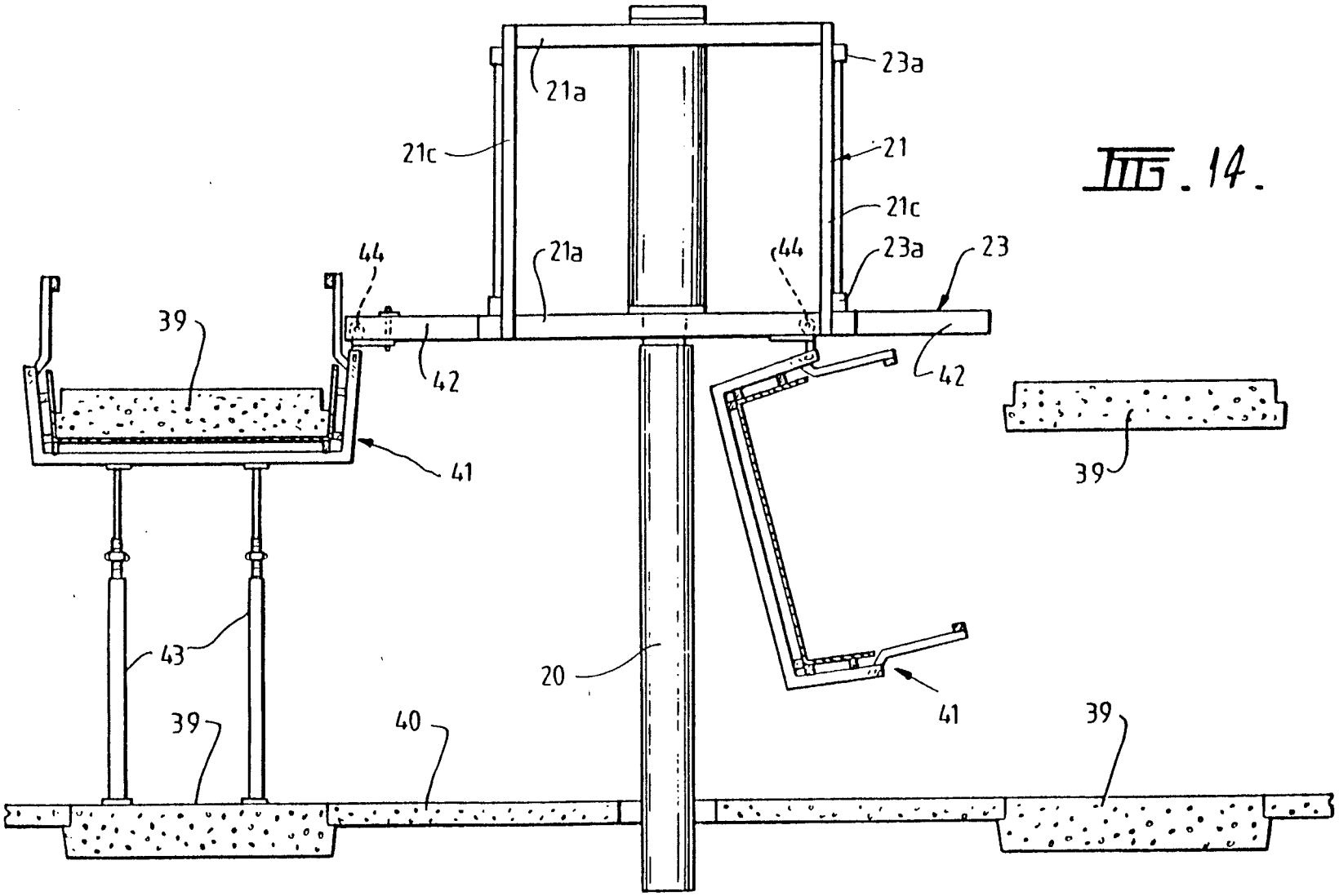
FIG. 14 is a cross-sectional view of an additional feature of the preferred embodiments of the system of the present invention whereby horizontal beams to support floor slabs may be formed.
Figure 15:
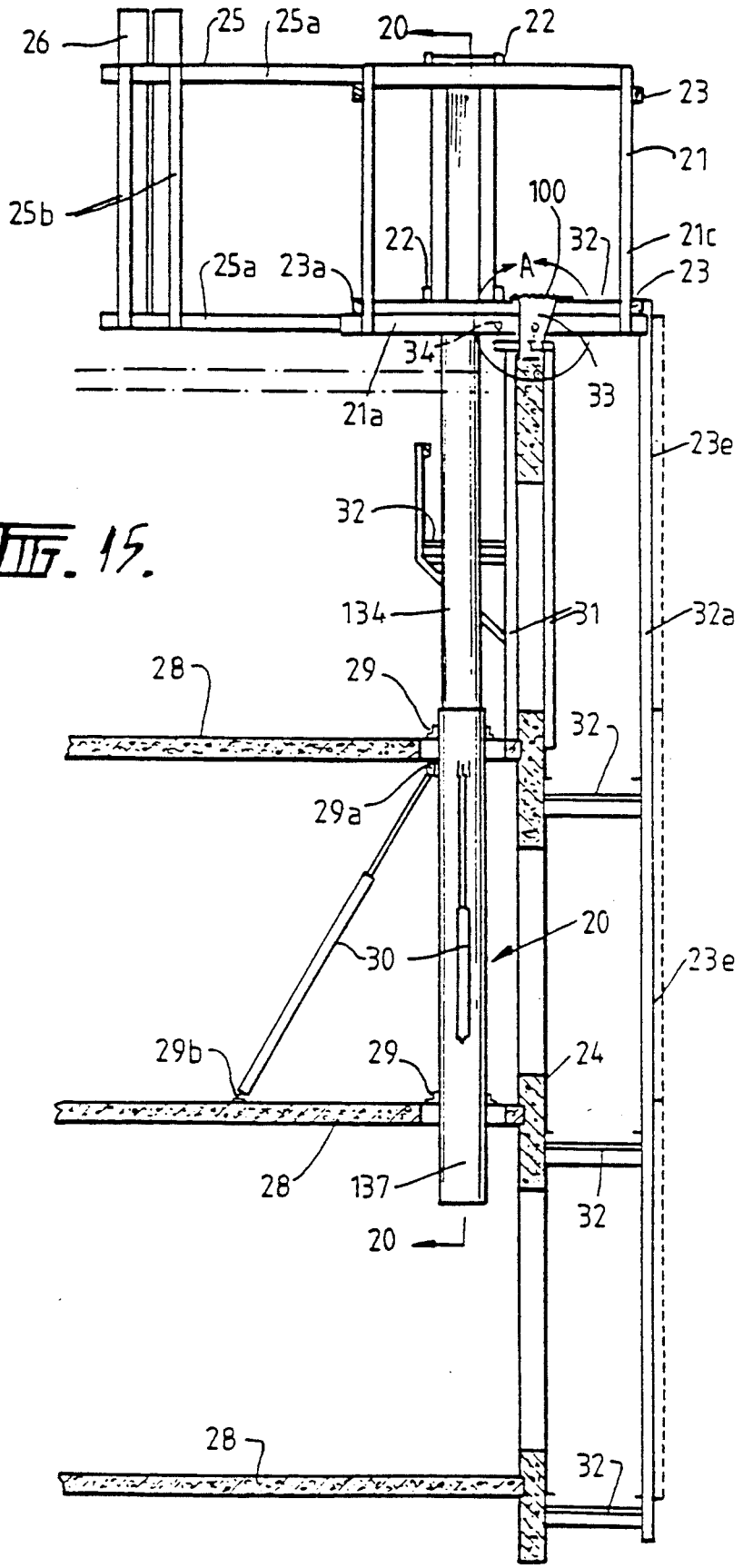
FIG. 15 is a cross-sectional view of a portion of a building being constructed similar to the view shown in FIG. 8 and in accordance with a third embodiment of the invention.

FIG. 14 of the drawings illustrates how the system of the preferred embodiments of the invention may also be adapted to form horizontal beams 39 within the building structure with interconnecting floor slabs 40, with provision to allow the beam casting formworks to be moved from below one beam casting level and upwardly to the next.

As shown to the left of FIG. 14, when a structural beam 39 is to be cast, the formwork 41, appropriately shaped, is suspended from the system by rollers 44 received and movable along structural members 42 of the main frame 23 and/or sub-frames 21, and pivots thereabout. During casting of the beam the formwork 41 is supported and held in position by vertical adjustable struts 43. After casting and curing of the concrete beam 39, and as shown to the right hand side of FIG. 14, the struts 43 are removed, the formworks 41 swung or allowed to swing downwardly about the axis of the rollers 44, whereafter extension of the jacks 20 allows the formworks 41 carried by the overhead frame work to move upwardly through the space between adjacent beams 39 and to the next level.

Referring to the embodiment of FIGS. 15 to 21 of the drawings, as with the previous embodiments, this embodiment of the invention comprises a plurality of jacking devices in this case in the form of extendable jacks. The extendable jacks are electric motor driven screw jacks 20 also strategically positioned having regard to the shape of the building to be constructed and positioned where vertical concrete walls and beams are to be constructed. The uppermost ends of each of the jacks or hydraulic rams carry the sub-frames 21 formed from the series of longitudinal frame members 21*a*, the lateral frame members (not visible), and the vertical frame members 21*c*, collectively affixed to the upper most ends of the rams via the connecting plates 22 on the upper and lower pairs of frame members 21*a*.

The sub-frames 21 in turn support the main frame 23 for the system and overlying the walls, columns and other vertical elements 24 of the building construction to be formed, and consisting of the longitudinal frame members, lateral frame members, vertical frame members and diagonals, with the longitudinal frame members being adapted to overlie the support members carried by the sub-frames 21 as in the previous embodiments.

In addition, each of the sub-frames 21 at the perimeter wall receives the counterweight frame 25, including longitudinal the frame members 25*a* received within the longitudinal frame members 21*a* of the sub-frames, which members 21*a* may be in the form of channel sections or hollow-sections within which the frame members 25*a* are received. The counterweight frames 25 also include the vertical members 25*b*, and the outermost ends of the counterweight frames support the counterweights 26 the weight of which is calculated to off-set the weight of the system on the opposite side of the axes of the rams at the positions of the rams, to thereby provide the stable balanced structure required for the system.

The lower ends of the rams 20 are positioned through the apertures in the floor slabs 28 and the support brackets 29 connect the rams 20 to the lowermost floor slabs, with the adjustable struts 30 being utilized to further support and vertically align the rams between the anchor points 29*a* on the jacks and the anchor points 29*b* on the floor slab 28. The main frame 23 is assembled on top of the sub-frames 21 with the longitudinal frame members 23*a* engaging the support members 21*d* of the sub-frames whereby the whole of the main frame, or independent sections thereof, are supported on the jacks 20 via their sub-frames 21.

To complete the system, the various working decks 32 for workmen and tradesmen are position within and suspended from the main frame, whilst the members 23*e* extending vertically downwardly from the main frame carry safety screens 32*a* which in this embodiment extend to two additional lower levels. In addition, the chutes 33 are provided through the deckings 32 on the main frame to communicate with the spaces between formworks 31 when the formworks are moved to the wall segment casting positions, and/or positions for the casting of other vertical components of the building structure. The formworks 31 are in turn suspended from the sub-frames or the main frame on the rollers 34 which allow the form works to be rolled into and away from the required concrete casting positions.

The progressive casting of vertical building components, such as vertical perimeter walls and the vertical walls of the building service core, and any vertical building columns, is as described in detail in connection with the previous embodiments.

In accordance with one of the modifications, the subject of this embodiment, the sub-frame 21 and the pouring chutes 33 are adjusted relative to the jacks 20, whereby to provide a greater amount of overhang beyond the perimeter of the building, and as such greater space between the perimeter of the building and the suspended safety screen 32*a*, for comfort and safety of workman situated on the platform 32 carried by the safety screen construction.

Figure 16:
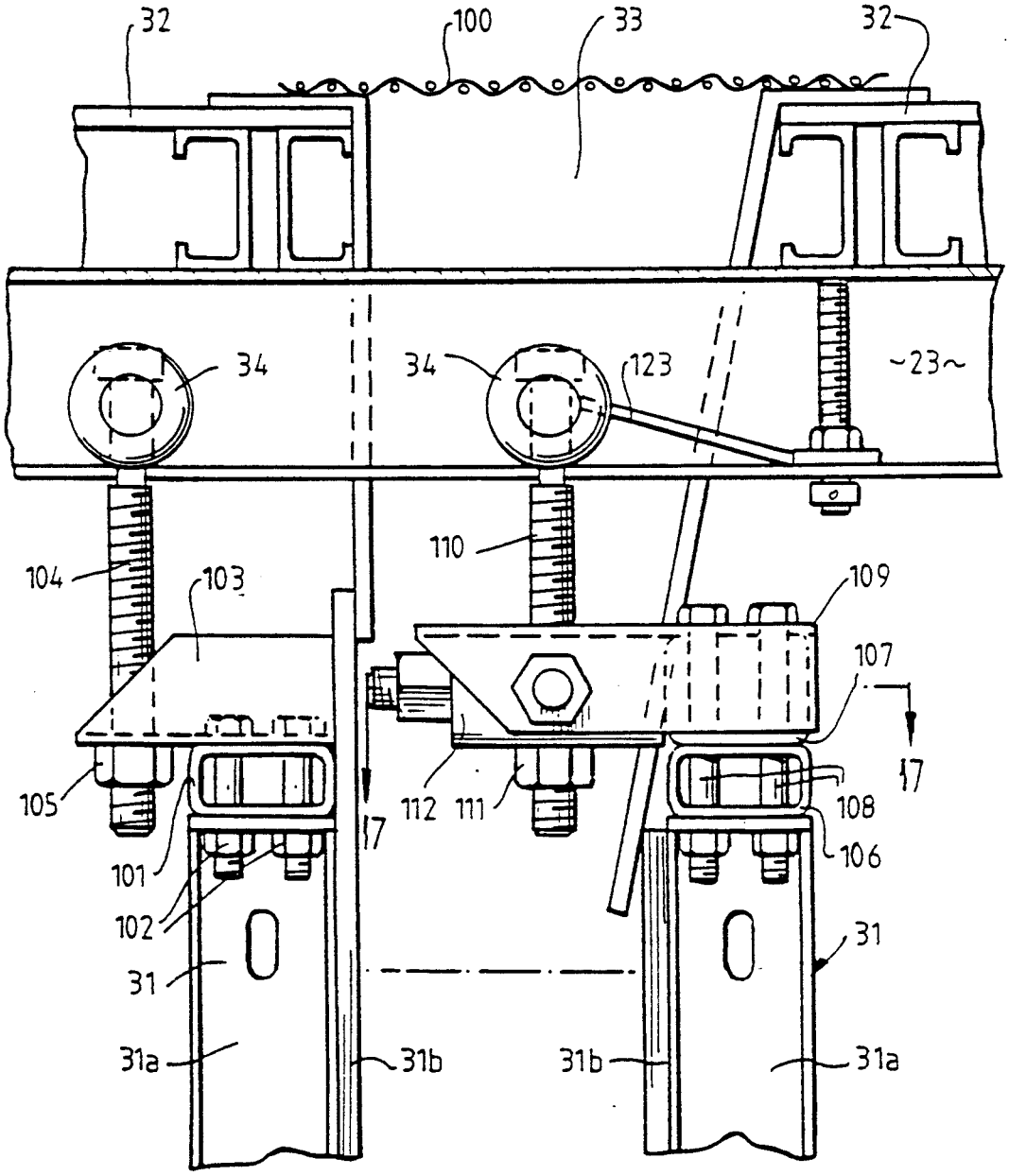
FIG. 16 is an enlarged view of part of the system of FIG. 15 as encircled by arrow A in FIG. 15.

In accordance with another of the modifications, the subject of this embodiment, and with particular reference to FIG. 16 of the drawings, the pouring chutes 33 are covered by mesh covers 100 through which concrete can be poured into the pouring slots between the tops of the formworks 31 and thereafter into the cavity between the formworks, and the mesh covers may be hinged (not shown) to an adjacent working platform 32 so that they can be swung out of the way if access to the pouring chutes and slots is required.

A still further modification, the subject of this embodiment, lies with the provision of attachments between the formworks 31 and the rollers to allow for fine adjustment of the positions of the formworks relative to the main frame 23, both upwardly and downwardly, as well as in the case of the outermost formwork, adjustment inwardly and outwardly of the building structure as well as along the building structure.

In the case of the innermost formworks 31 shown on the left in FIG. 16, the upper ends of the vertical frame members 31*a* of the formworks, to which timber panels 31*b* are attached, are coupled via horizontal frame members 101 and bolts 102 to a bracket 103 having a hole through one end, through which is received a threaded suspension member 104, carrying a nut 105 on the end thereof beneath the bracket. The upper end of the suspension member is connected to an axle about which the roller 34 rotates as it rolls along the flange of the structural member forming part of the main frame 23. By adjusting the nut 105 along the end of the suspension member 104, the association formwork is raised or lowered relative to the overhead main frame.

Figure 17:
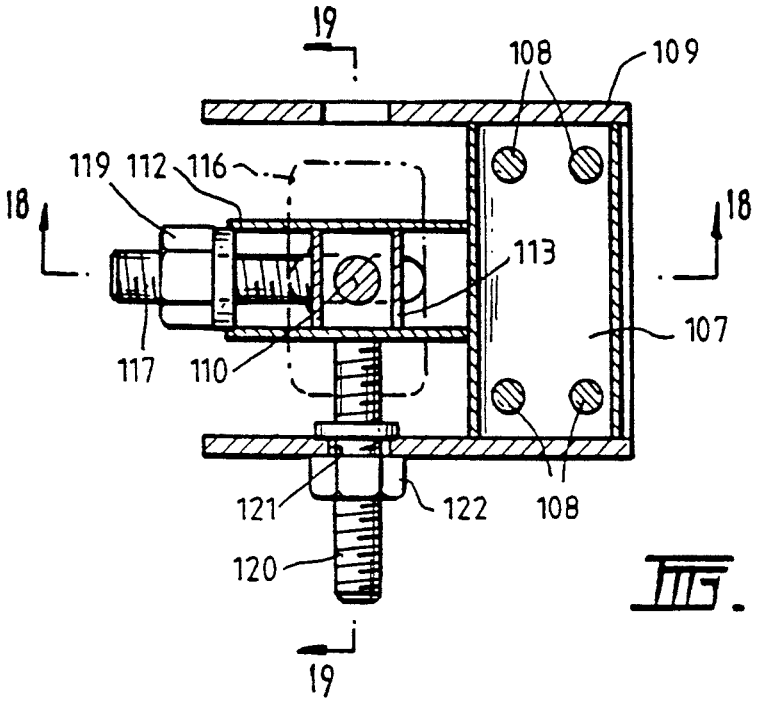
FIG. 17 is a cross-sectional view taken along line 17—17 of FIG. 16.
Figure 18:
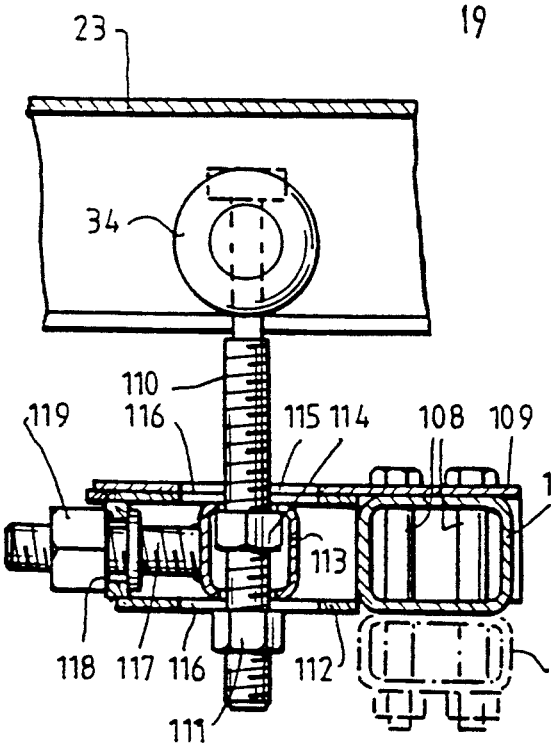
FIG. 18 is a cross-sectional view taken along line 18—18 of FIG. 17.
Figure 19:
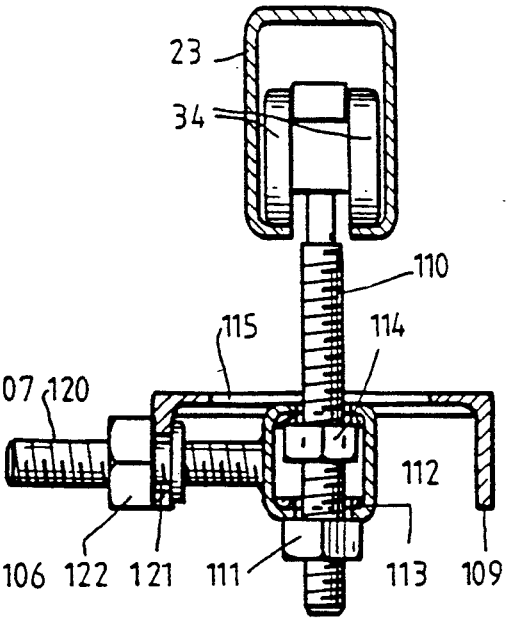
FIG. 19 is a cross-sectional view taken along line 19—19 of FIG. 17.
Figure 22:
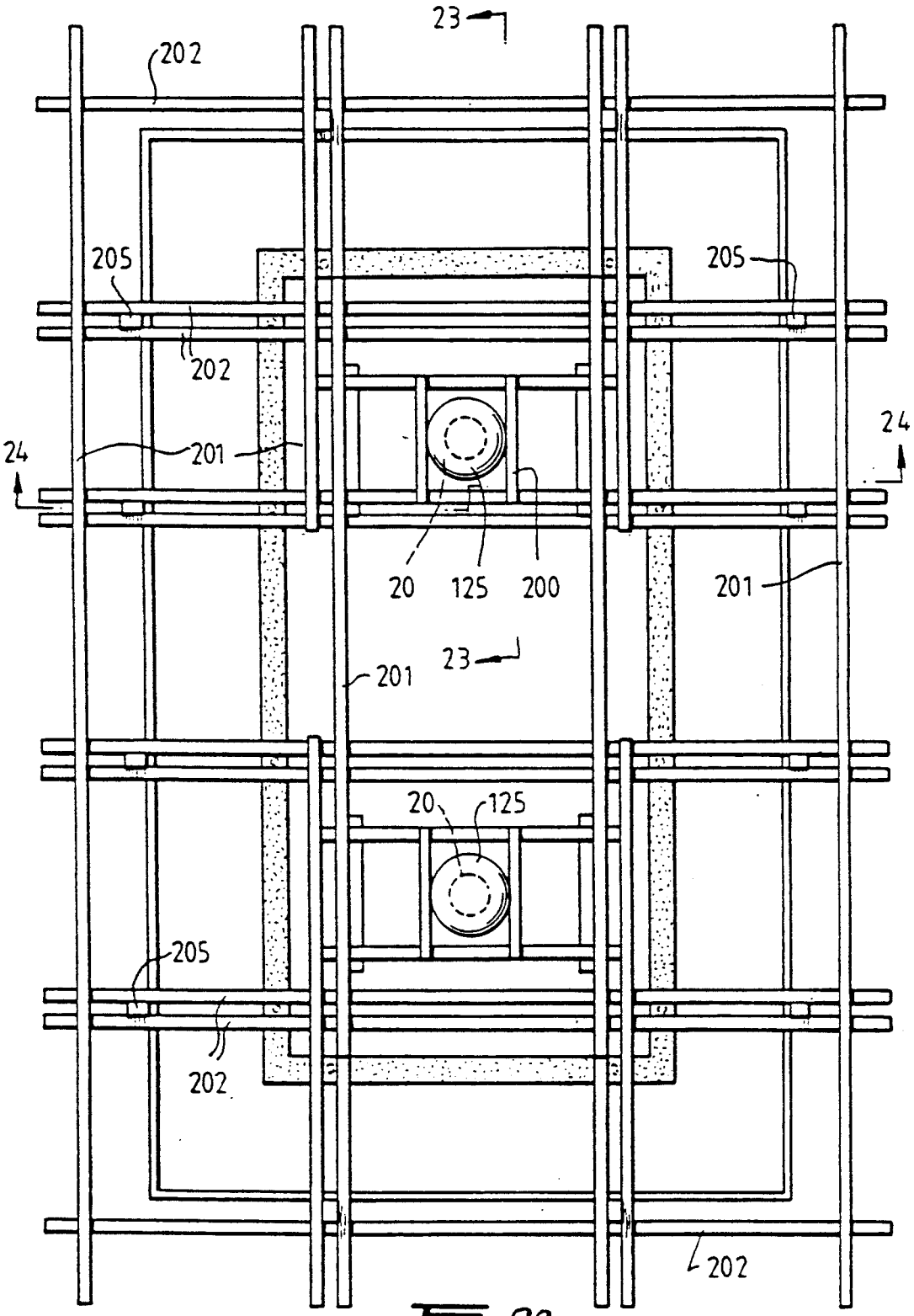
FIG. 22 is a plan view of a building construction system in accordance with the fourth embodiment of the invention as particularly adapted to construct a service core in a multi-storey building.
Figure 23:
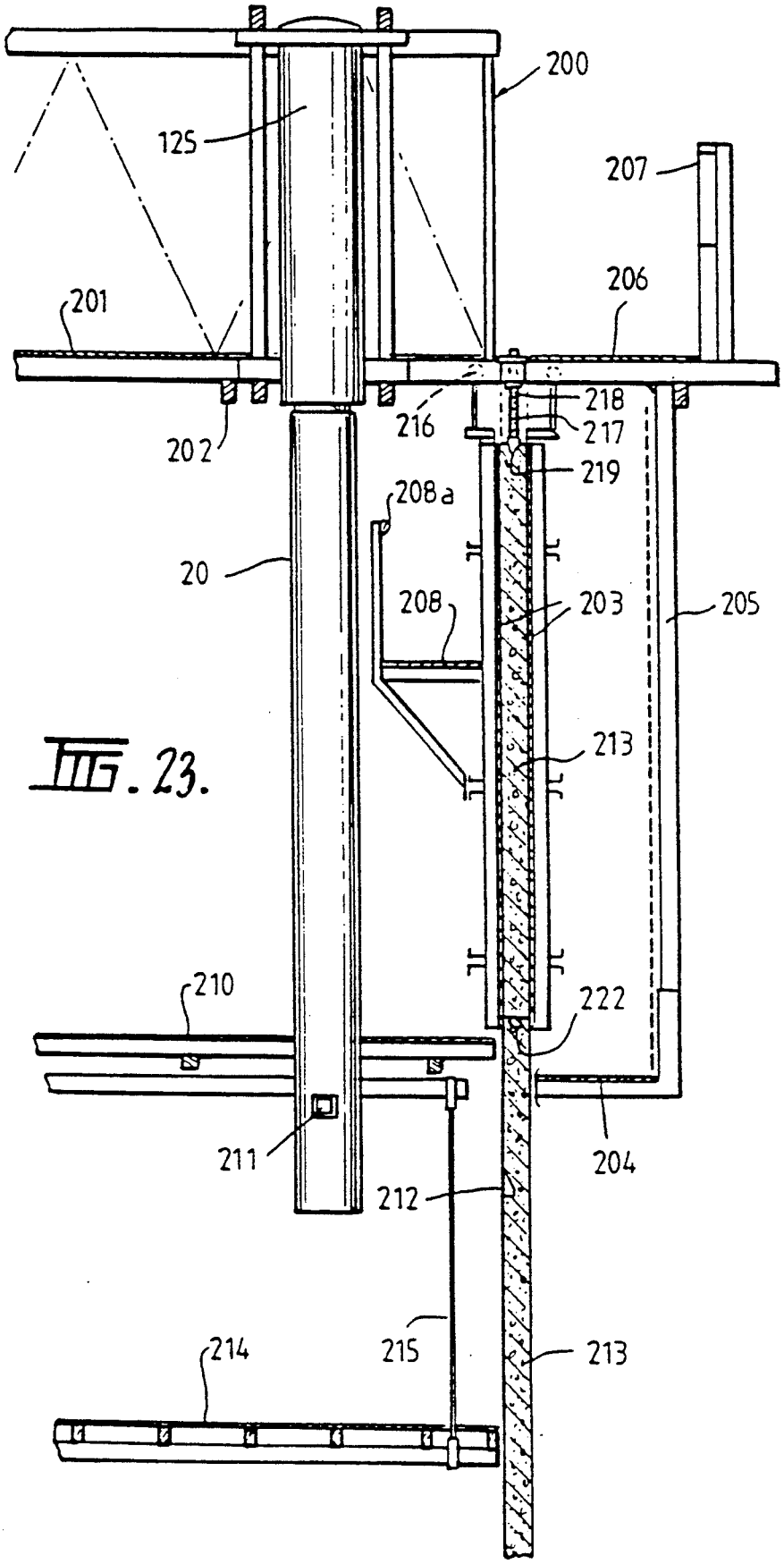
FIG. 23 is a longitudinal cross-section view taken along 23—23 of FIG. 22.

In the case of the outermost formwork 31 shown on the right in FIG. 16, and with reference to FIGS. 17 to 19, the upper ends of the vertical frame member 31*a* are also coupled with bolts 108, via a horizontal frame member 106 and spacers 107, to a bracket 109 in the form of an inverted channel section, through which a threaded suspension member 110 carrying a nut 111 extends for vertical adjustment similar to that for the inner formwork. An adjustment housing 112 is received within the bracket 109, and the housing, in turn, receives an adjustment member 113 through which the suspension member 110 passes to be attached thereto by a nut 114. The suspension member also passes through an aperture 115 in the bracket 109 aligned with apertures 116 in the adjustment housing 112, all of which apertures are larger than the diameter of the suspension member 110 to accommodate relative movement thereto. The adjustment member 113 carries an elongate threaded horizontally disposed adjustment member 117 which extends through a hole 118 in the end wall of the adjustment housing 112, and carries a nut 119 externally of the housing, which, when adjusted along the member 117, causes the associated formwork 31 to move toward and away from the other formwork. The adjustment housing 112 also carries an elongate threaded horizontally disposed adjustment member 120 which extends through a hole 121 in one of the flanges of the inverted channel section forming the bracket 109, and also has a nut 122 associated therewith which, when adjusted along the member 120, will cause the bracket 109 and the formwork associated therewith to move backwards and forwards along the length of the building structure. It will be apparent from the above that adjustment of the outer formwork can be facilitated in three directions, namely, upwardly and downwardly, inwardly and outwardly, and back and forth along, the main frame 23 to allow for fine adjustment of the formwork position relative to the building being constructed.

With reference again to FIG. 16 of the drawings, the axle for the rollers 34 for the outermost formwork 31 carries a strap 123 which, in turn, is bolted to a convenient location through the flange of the associated member of the main frame 23 to hold the roller in position when the associated formwork 31 is at the correct casting position.

Referring to FIG. 20 of the drawings, each jack 20 is an electric motor driven screw jack, and the operation of each jack may be controlled to operate simultaneously with the other jacks whereby all will be extended or retracted in unison to keep the construction system as a whole level.

Each jack comprises a tubular motor housing 125 closed at the top and bottom by end walls 126 and 127 respectively. The upper end of the housing contains an electric motor 128 which drives a threaded power screw 129 via an electromagnetic clutch 130, a gear box 131, a torque limiting coupling 132, and a bearing arrangement 133. A tubular fixed jack rod 134 forming an inner jack column is provided attached within the housing adjacent the bearing arrangement 133 and extends from within, and downwardly from, the housing into a co-axial outer column 137 for telescopic movement in relation thereto. A support tube 135 is received within the inner jack column 134 to be axially telescopingly movable therein and through a hole 134*a* in the end of the column 134, and has its lower end connected at 136 to the bottom of the interior of the outer column 137. The upper end of the support tube 135 carries a collar 138 internally threaded to engage with the externally threaded power screw 129.

When the power screw 129 is rotated in one direction the motor housing 125, and the sub-frame and main frame supported thereon, will be driven (raised) upwardly whilst the support tube 135 attached to the outer column 137 remains fixed to the lower building structure as shown in FIG. 8 of the first embodiment of the invention. When the power screw 129 is rotated in the opposite direction, with the outer column 137 detached from the lower building structure, and the main frame 23, sub-frames 21, and accordingly the housing 125, fixed at an elevated position, the outer column 137 and the support tube 135 will be drawn respectively upwardly around and within the inner jack column 134 as shown in FIG. 10 of the first embodiment of the invention.

As discussed previously, in a preferred embodiment of the present invention the safety screen construction 32*a* is one in which prefabricated screen sections of standardized width are provided with arrangements of holes or slots adjacent their edges in lines extending inwardly thereof, whereby the varying lengths of perimeter walls, gaps between screen sections during assembly of the safety screen which are less than the width of the screen sections themselves, can be filled by overlapping adjacent edges of the screen sections with a selected pair of holes or slots in the sections aligned to receive attachment means such as bolts or other fastening devices.

In addition, and also in accordance with a preferred embodiment of the invention, the main frame 23 may be formed from prefabricated frame sections, which frame sections are brought to the site and positioned onto the pre-positioned jacking devices 20 and sub-frames 21, whereafter the prefabricated frame sections are connected together to form a unitary main frame, or some may be left unconnected whereby individual lengths of the main frame can be raised independently of each other to allow vertical concrete walls or components to be formed at differing heights in accordance with a predetermined building schedule to provide some versatility in the utilization of building workers.

Turning to FIGS. 22 to 27 of the drawings, the construction system of this fourth embodiment of the invention, as particularly utilized for constructing service cores in multi-storey buildings, comprises upper or head frames 200 forming part of the sub-frames and main frame and supporting the tubular motor housings 125 of screw jacks 20 similar to that of FIGS. 20 and 21, and downwardly from which the remainder of the screw jacks 20 extend. In this case, two screw jacks for the particular core shaft under construction are provided. The head frames 200 are, in turn, supported on an underlying grid of longitudinally and transversely extending main frame members 201 and 202 from which various formworks 203, and screens 205 carrying working platforms 204, are suspended. In this embodiment working platforms 206 with perimeter safety barriers 207 are provided on top of the grid of main frame members.

Figure 24:
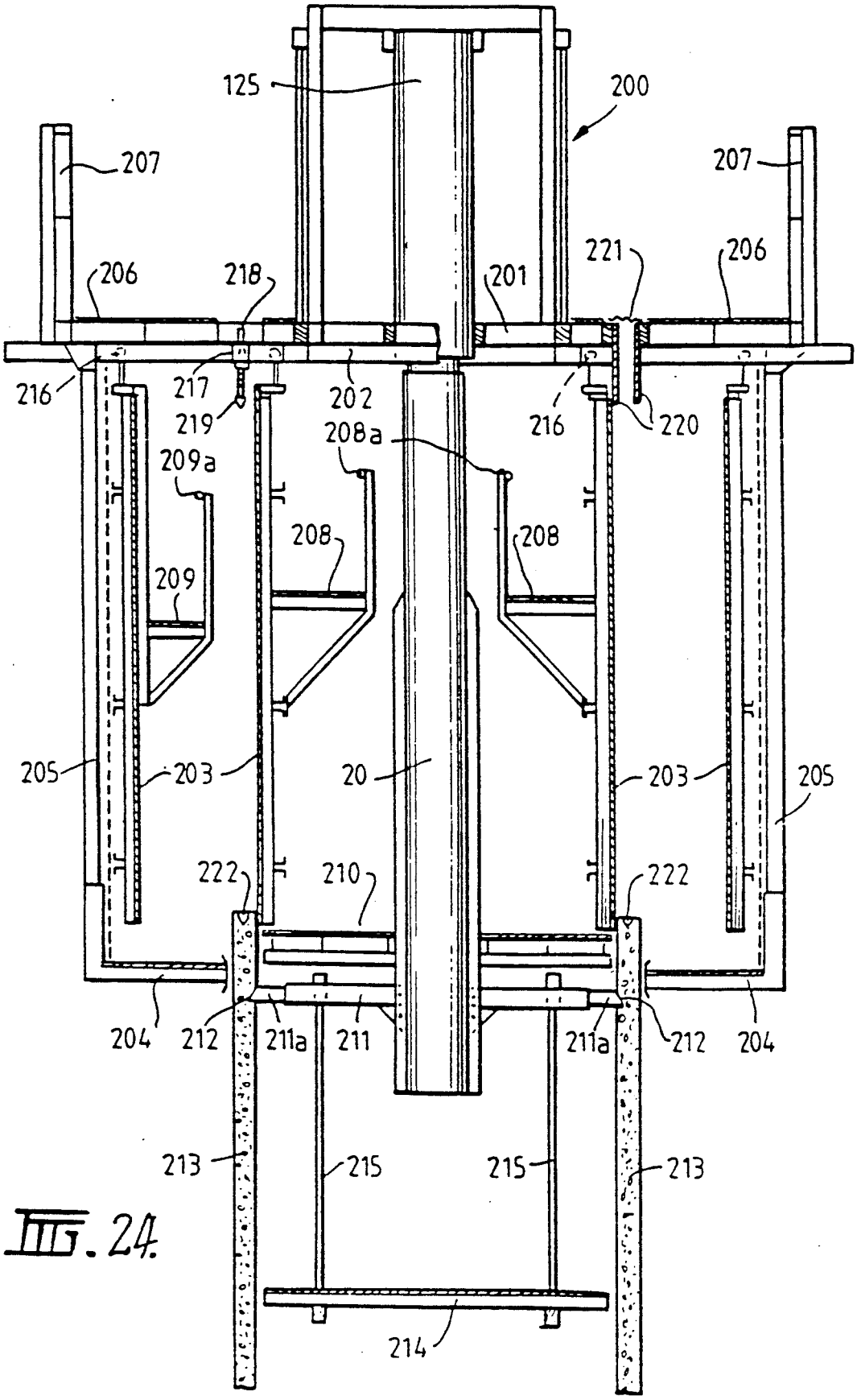
FIG. 24 is a transverse cross-sectional view taken along line 24—24 of FIG. 22.
Figure 25:
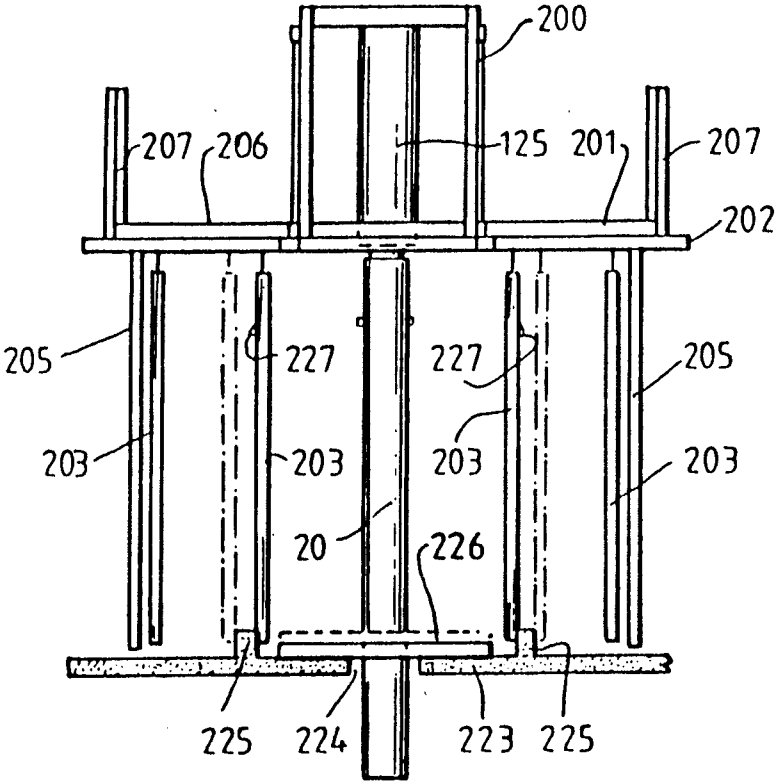
Figure 28:
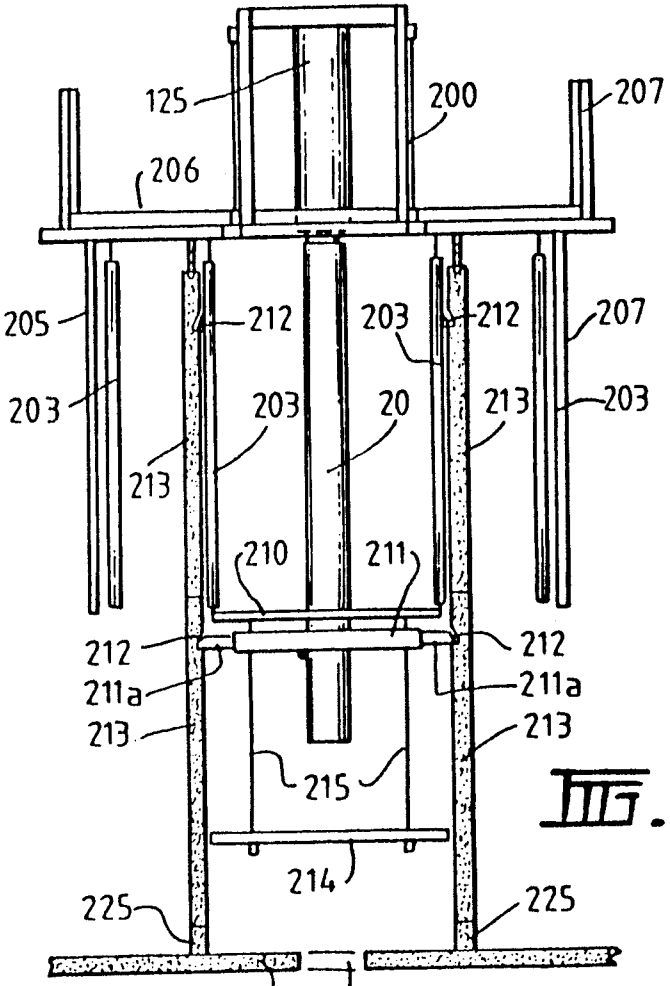

In addition, the formworks themselves support internal working platforms 208 with hand rails 208*a* at the inner formworks and bolted thereto, and external working platforms 209 with hand rails 209*a* which are hooked over the upper edges of the external formworks when the external formworks are moved to their outermost positions as shown in FIGS. 24 and 25 of the drawings and to allow access by workmen for cleaning of the formwork surfaces. The lower ends of the inner formworks have a further internal working platform 210 suspended therefrom.

The lower ends of the screw jacks 20 carry retractable shear keys 211 which, at various times, engage in pockets 212 formed in the inner side of the walls of the vertically superimposed wall segments 213 of the core as it is constructed. A still further and lowermost working platform 214 is, in turn, suspended from the shear keys by means of hangers 215 to allow access to the inside surfaces of previously cast wall segments for cleaning and finishing operations.

As with the previous embodiments, the upper ends of the formworks are suspended from the overhead frame members via rollers 216 with adjustment of the formworks in three directions being achieved by adjustment mechanisms of the type previously described and illustrated with reference to FIGS. 17 to 19 of the drawings.

The system of this fourth embodiment of the invention includes a number of feet assemblies 217 for supporting the system on an underlying previously cast wall segment 213, and comprise vertically adjustable screw members 218 within large support heads 219 for engaging in sockets 222 formed in the top edge of the underlying wall segment by the heads 219 as the segment is cast. Concrete pouring chutes 220 are provided in line with the wall segments to be constructed and with mesh covers 221. In this fourth embodiment of the invention the wall construction system is alternately supported on a previous cast wall segment by the retractable shear keys 211 or the feet assemblies 217.

FIGS. 25 to 28 show the first four stages in casting a wall segment, and particularly the first wall segment 213 on a floor slab 223 at ground level. The floor slab 223 has an opening 224 therethrough communicating with a space or cavity beneath the slab and into which the lower ends of the screw jacks 20 can extend. A series of short starting walls 225 are firstly poured and allowed to solidify.

The majority of the wall construction system is then assembled by locating the screw jacks 20 through the openings 224 and supported by a temporary bottom support frame 226 spanning between the starting walls 225. The screw jacks 20 are then temporarily braced to each other and/or the bottom support frame 226. The head frames 200 are then positioned on the screw jacks, if not already attached, the grid of main frame members 201 and 202 is then assembled complete with the working platform 206 and safety barriers 207, and the inner and outer formworks 203 then placed in their suspended positions, together with the feet assemblies 217, chutes 220 and mesh covers 221.

The formworks are then moved to their wall casting positions and the first wall segment 213 is then cast to extend upwardly from the starting walls 225, and the wall segments then allowed to solidify. Prior to casting the wall segments, any reinforcement, block-outs for wall openings and shear key pocket forming means, such as 227, are positioned.

Figure 26:
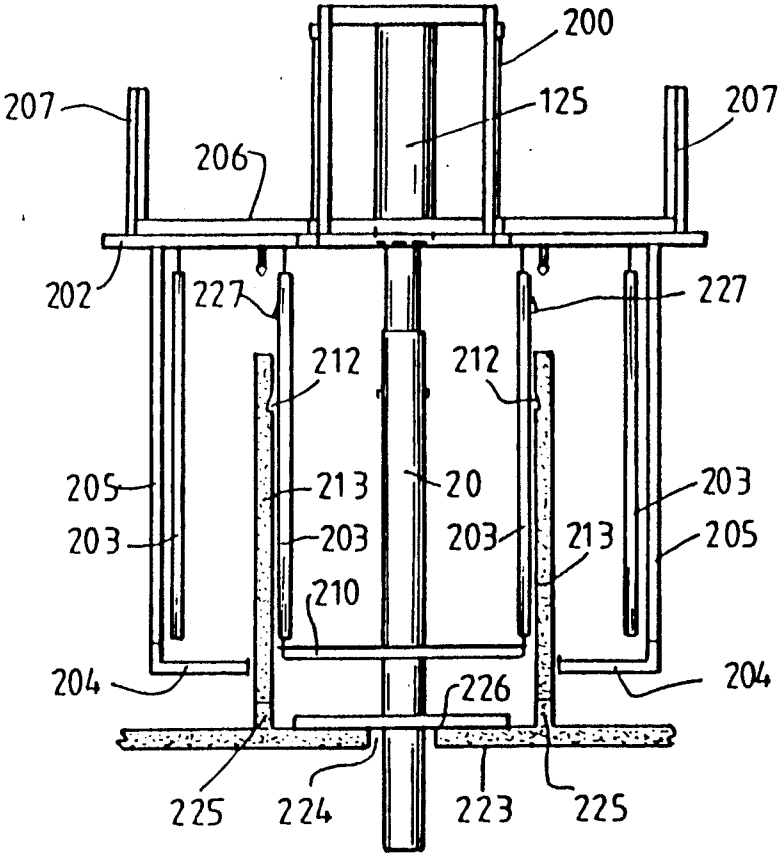
FIGS. 25, 26, 27 and 28 are transverse cross-sectional views similar to FIG. 24, but more schematic in nature, showing four successive stages during use of the system to progressively construct vertically superimposed wall sections for a service core for a multi-storey building.
Figure 27:
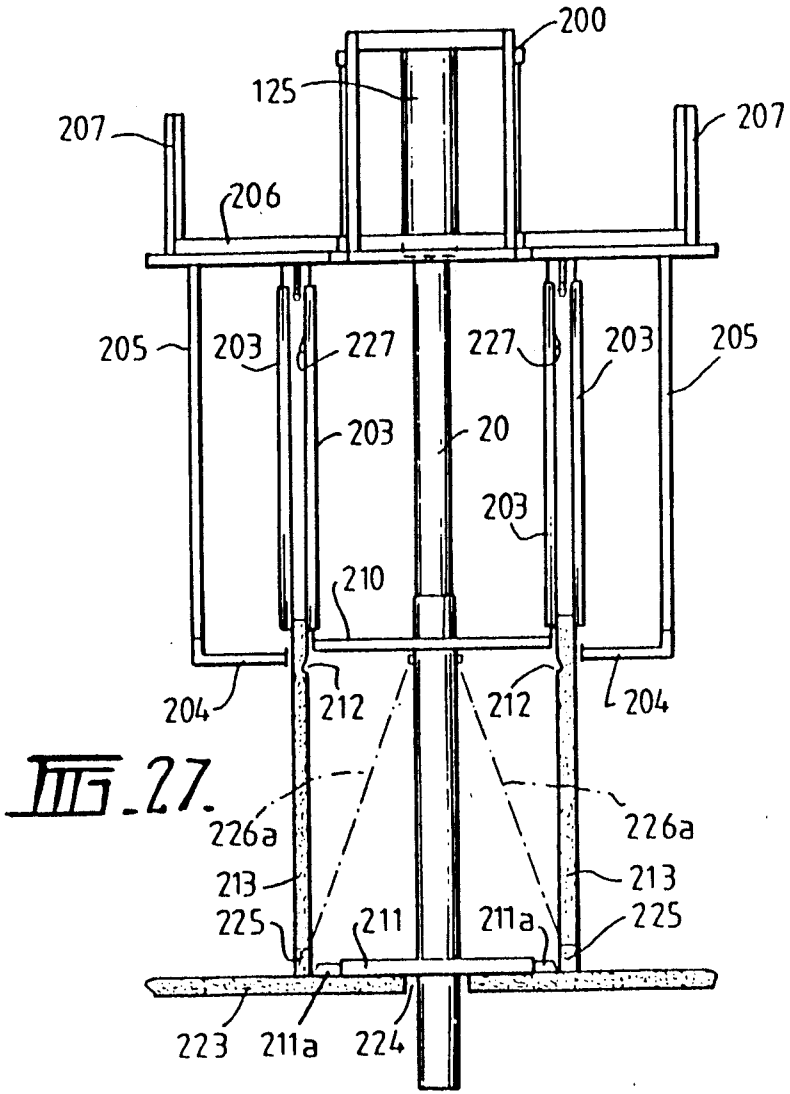

After solidification of the wall segments 213 the formworks are separated and the system is raised on the screw jacks 20 to the position shown in FIG. 26 where the lower inner and external platforms 210 and 204 are attached whereafter, the screw jacks are extended to raise the whole system to the next wall segment casting level as shown in FIG. 27.

The feet assemblies 217 are then lowered to a position between the formworks such that when the formworks are again moved to their casting positions, and the necessary reinforcements and block-outs positioned, the pouring of concrete will produce second wall segments 213 vertically superimposed on the first wall segments and extending up to, and around, the support heads 219 of the feet assemblies 217.

After solidification of the second level of wall segments 213, and with the system supported on top of the second wall segments via the feet assemblies 217, the screw jacks are braced by temporary bracings **226*a* the temporary support frame 226 can then be removed and replaced with the retractable shear keys 211. The temporary bracings 226*a* can then be removed. The screw jacks are then reversed such as to retract, and in effect lift the shear keys 211 to the position shown in FIG. 28 whereby the engaging noses 211*a* which are biased outwardly of the shear keys will engage with the pockets 212 cast in the first level of the wall segments 213. The lowermost working platform 214, with its hangers 215**, is then positioned and assembly of the whole of the wall construction system is completed.

The raising of the system to construct subsequent higher wall segments is achieved by extending and retracting the screw jacks 20 with the system being alternately supported by the shear keys 211 when the screw jacks are extended to raise the system to the next casting position, or suspended by the feet assemblies 217 when the screw jacks are retracted to raise the shear keys to their next support position.

The service core construction system of this fourth embodiment of the invention may be combined with peripheral wall and beam construction systems of the type the subject of the preceding embodiments to allow both service core and building construction at the same time, and generally in advance of the construction of perimeter walls, beams and floor slabs.

As well as reinforced concrete structures, the system of the present invention is designed to construct concrete encased steel structures. Floor to floor heights (levels) in commercial buildings are in the range 2.7 m to 4.0 m. In the case of concrete encased steel structures, the rams 20 and associated bracing may advance the placement of perimeter steel elements two levels in advance in order to satisfy steel alignment specifications in advance of concrete encasement. It will be appreciated that the rams 20 and the associated bracing will need to extend an additional floor level and the size and the extent of this additional supporting structure will be considerable.

The system of the present invention has considered all relevant trades, and as such, the platforms provided for pouring concrete and working decks for carpenters and other tradesmen at the appropriate levels and locations. These platforms are constantly provided and require no manual shifting from one level to another as they are carried along with the advancing of the system.

The safety screens added about the perimeter of a building, are also carried with the system. The screens can be carried down several floors to protect perimeter trades below. The entire perimeter may be clad to add psychological security to work undertaken in this area of the building construction.

The continuing presence of working platforms and safety screens, and their automatic advance with the system, reduces the amount of work and facilitates the ease and speed with which the construction operations are completed.

The majority if not all of the structural components of the system can be manufactured off-site and shipped thereto for subsequent assembly with other components on-site.

I claim:

1. A building construction system for progressively forming a plurality of vertical superimposed concrete segments in a building, said system comprising a plurality of jacking devices forming support columns having upper ends each carrying sub-frames onto which a main frame overlying positions at which the segments are to be formed is adapted to be positioned, and from which form works are suspended to be movable to positions to define spaces within which concrete is poured to form said segments, said jacking devices being adapted to be supported on a lower previously constructed horizontal building element of said building preceding a previously constructed horizontal building element of said building and retractable while said main frame is supported on temporary supports to reposition said jacking devices for support on the previously constructed horizontal building element of said building structure.

2. A building construction system as claimed in claim 1 wherein said temporary supports are adjustable struts supporting sub-frames on part of an underlying completed building segment.

3. A building construction system as claimed in claim 1, wherein said temporary supports are means engaging top edges of an underlying completed building segment.

4. A building construction system as claimed in claim 3, wherein said supports are precast pockets in an underlying previously cast wall segment.

5. A building construction system as claimed in any of claims 1 to 3, wherein the positions of the sub-frames relative to the jacking devices are adjustable, to facilitate the pouring of concrete.

6. A building construction system as claimed in any one of claims 1 to 3, wherein perimeter safety screens are provided to extend several floors below that from which a particular wall segment is being formed at any time, whereby workman situated on platforms suspended therein can carry out finishing work at floors below with relative safety, and which safety screens are adapted to rise progressively.

7. A building construction system as claimed in claim 6, wherein screen sections forming said safety screens are prefabricated and of standardized widths having edges near which are positioned arrangements of openings for overlapping assembly to accommodate varying lengths of perimeter wall.

8. A building construction system as claimed in any one of claims 1 to 3, wherein the main frame is formed from prefabricated frame sections which are brought to a site and positioned onto pre-positioned jacking devices and sub-frames.

9. A building construction system as claimed in claim 8, wherein the frame sections are connected together for form a unitary main frame.

10. A building construction system as claimed in claim 8, wherein some of the frame sections are connected together and others are unconnected for raising individual lengths of the main frame independently of each other to allow vertical concrete walls and components to be formed at differing heights in accordance with a predetermined building schedule.

11. A building construction system as claimed in any one of claims 1 to 3, wherein pouring chutes for concrete are provided above the spaces between the form works, and mesh covers are provided over the openings to the pouring chutes for pouring concrete through the mesh whilst at the same time preventing building workers from falling into and through the pouring chutes.

12. A building construction system as claimed in claim 11, wherein the mesh covers are hinged to adjacent working platforms for swinging upwardly out of the way when access to the pouring chutes is required.

13. A building construction system as claimed in any one of claims 1 to 3, wherein means are provided to allow adjustment of the formworks at their points of suspension from the overhead main frame.

* * * * *